US012716300B2

(12) United States Patent
Schryver

(10) Patent No.: US 12,716,300 B2
(45) Date of Patent: Aug. 25, 2026

(54) RELEASABLE RETRIEVING TOOL WITH LUG AND SLOT CONNECTION

(71) Applicant: VANGAARD DOWNHOLE INC., Leduc (CA)

(72) Inventor: Jeff D. Schryver, Beaumont (CA)

(73) Assignee: VANGAARD DOWNHOLE INC., Leduc (CA)

( * ) Notice: Subject to any disclaimer, the term of this patent is extended or adjusted under 35 U.S.C. 154(b) by 1056 days.

(21) Appl. No.: 17/780,403

(22) PCT Filed: Dec. 18, 2020

(86) PCT No.: PCT/CA2020/051743
§ 371 (c)(1),
(2) Date: May 26, 2022

(87) PCT Pub. No.: WO2021/119825
PCT Pub. Date: Jun. 24, 2021

(65) Prior Publication Data

US 2023/0039813 A1 Feb. 9, 2023

Related U.S. Application Data

(60) Provisional application No. 62/951,373, filed on Dec. 20, 2019.

(51) Int. Cl.
*E21B 17/06* (2006.01)
*E21B 31/00* (2006.01)

(52) U.S. Cl.
CPC ..... *E21B 17/06* (2013.01); *E21B 31/00* (2013.01)

(58) Field of Classification Search
CPC ..... E21B 17/06; E21B 31/00; E21B 31/20
See application file for complete search history.

(56) References Cited

U.S. PATENT DOCUMENTS 2,840,168 A * 6/1958 Berry ..... E21B 17/06 175/294
2,919,900 A * 1/1960 Segelhorst ..... E21B 17/06 285/86
2,978,048 A * 4/1961 Walker ..... E21B 17/06 285/402
3,056,614 A * 10/1962 Mcclintock ..... E21B 17/06 285/376
3,061,336 A * 10/1962 Waggener ..... E21B 17/06 285/84
3,082,831 A * 3/1963 Bus, Sr. ..... E21B 31/16 166/240
3,097,001 A * 7/1963 Lebus, Sr. ..... E21B 17/06 285/361

(Continued)

*Primary Examiner* — Jennifer H Gay
(74) *Attorney, Agent, or Firm* — Holzer Patel Drennan

(57) ABSTRACT

Apparatus and methodologies for recovering equipment from a subterranean wellbore are provided, the apparatus operative to both disconnect uphole equipment from downhole equipment that has become lodged in the wellbore, salvaging the uphole equipment, and then to reconnect with the downhole equipment to fish the equipment from the wellbore. More specifically, the apparatus and methodologies comprise a modified fishing tool having two tubular portions that can be easily and efficiently be disconnected and reconnected with one another.

17 Claims, 21 Drawing Sheets

(56) References Cited

U.S. PATENT DOCUMENTS

| | | | | | |
|---|---|---|---|---|---|
| 3,098,667 | A * | 7/1963 | Greenwood | E21B 17/06 | 285/376 |
| 3,169,593 | A * | 2/1965 | Bus, Sr. | E21B 31/16 | 175/315 |
| 3,178,205 | A * | 4/1965 | Bus, Sr. | E21B 17/06 | 285/361 |
| 3,265,135 | A * | 8/1966 | Wilkinson | E21B 17/10 | 166/158 |
| 3,355,189 | A * | 11/1967 | Hasha | E21B 17/06 | 285/39 |
| 3,727,948 | A * | 4/1973 | Current | F16L 15/006 | 285/391 |
| 5,074,361 | A * | 12/1991 | Brisco | E21B 29/00 | 166/240 |
| 7,337,852 | B2 * | 3/2008 | Manke | E21B 31/20 | 166/242.6 |
| 9,500,044 | B2 * | 11/2016 | Twardowski | E21B 17/02 | |
| 2004/0084176 | A1 * | 5/2004 | Hackworth | E21B 17/04 | 166/227 |
| 2006/0260819 | A1 * | 11/2006 | Manke | E21B 31/20 | 166/242.6 |
| 2008/0041597 | A1 * | 2/2008 | Fisher | E21B 17/06 | 166/381 |
| 2012/0298376 | A1 * | 11/2012 | Twardowski | E21B 31/20 | 166/242.6 |
| 2013/0140019 | A1 * | 6/2013 | Pare | E21B 17/06 | 166/117.5 |
| 2022/0178217 | A1 * | 6/2022 | Egbe | E21B 17/06 | |
| 2023/0039813 | A1 * | 2/2023 | Schryver | E21B 31/00 | |

* cited by examiner

RELEASABLE RETRIEVING TOOL WITH LUG AND SLOT CONNECTION

FIELD

Embodiments herein generally relate to improved apparatus and methodologies for recovering use of a subterranean wellbore in circumstances where the wellbore has become blocked by downhole equipment. Specifically, an improved apparatus and method of use are provided, the apparatus operative to both disconnect uphole equipment from downhole equipment that has become lodged in the wellbore, salvaging the uphole equipment, and then to reconnect with the downhole equipment to fish the equipment from the wellbore.

BACKGROUND

It is not uncommon for downhole equipment, such as drilling equipment, to become lodged within a subterranean wellbore during oil and gas drilling operations. The lodged equipment cannot be removed by the application of ordinary upward (pulling) forces, resulting in the shutdown of drilling operations until the blockage can be removed and the use of the wellbore can be recovered. Currently, in such cases, specialized 'release' tools positioned within the drill string are used to selectively separate the string uphole of the lodged equipment, salvaging the uphole string. For example, separation of the string can be triggered at a specific point of separation (i.e. a 'safety joint'), such safety joints typically comprising two main components that are connected by a threaded section and are separated by reverse rotation of the string. The safety joint threaded section is designed to unscrew at lower torque than other parts of the drill string. Once the uphole string has been removed, dedicated 'retrieval' equipment can then be run in a fishing operation to recover the disconnected components at the bottom of the string. However, because torque often does not transmit well along the drill string, many rotations are required, and the string itself can be put under large amount of force. This can damage the drill string and takes times to accomplish.

Although such methods of reclaiming the use of a wellbore can be effective in some circumstances, current methods have many drawbacks due to the inability to conveniently separate and release the lodged equipment, as well as due to the inability to effectively re-engage with the lodged equipment with known fishing tools, particularly in horizontal wellbores. Moreover, known release tools are not configured to withstand the torques applied during fishing operations (i.e. known J-slot separation tools fail when jarred), requiring that separate tools be used for each operation. As a result, when equipment becomes lodged within a wellbore, oil and gas producers continue to suffer from substantial delays and increasing costs with each passing hour.

There remains a need for an improved dual-purpose tool operative to both effectively separate uphole drill string from lodged downhole drilling equipment, and then to further conveniently reconnect with and retrieve the lodged equipment. Such a tool may comprise a fishing tool operative to easily release the lodged equipment downhole, and then to readily reengage the equipment for retrieval from the wellbore.

The presently improved apparatus and methodologies will now be described in more detail having regard to the following description of embodiments and related drawings.

SUMMARY

According to embodiments, an apparatus for use in retrieving equipment from of a subterranean wellbore is provided, the apparatus comprising a first housing tubular, the housing tubular forming a central bore having an inner surface providing a plurality of lugs protruding from and longitudinally spaced along the inner surface, a second inner fishing tubular, the fishing tubular having an outer surface forming a plurality of slots corresponding with the plurality of lugs, wherein, when the fishing tubular is slidably received within the central bore of the housing tubular, the plurality of lugs correspond to and interconnect with the plurality of slots, releasably connecting the housing tubular and the fishing tubular. Connection between the housing and fishing tubulars may be reinforced by a shear pin connection.

In some embodiments, the outer surface of the fishing tubular may further comprise at least one chamfer for aligning the interconnection between the housing tubular and the fishing tubular. In other embodiments, the outer surface of the fishing tubular may further comprise at least one guide channel for guiding the interconnection between the housing tubular and the fishing tubular. In yet other embodiments, the outer surface of the fishing tubular may further comprise two diametrically opposed guide channels, each guide channel positioned between an operably connected with at least one upper and lower chamfer.

In some embodiments, the slots may comprise a plurality of T-shaped slots. In other embodiments, the plurality of lugs may comprise at least four lugs, wherein one of the plurality of lugs is of a different size and shape than the other at least three lugs.

According to embodiments, a method of retrieving equipment from a subterranean wellbore is also provided, the method comprising providing at least one apparatus for retrieving the equipment, the apparatus comprising a first housing tubular releasably connected and rotatable with a second fishing tubular, lowering the apparatus into the wellbore, disconnecting the apparatus by rotatably disengaging the first housing tubular from the second fishing tubular, and removing the first housing tubular from the wellbore, and reconnecting the apparatus by lowering the first housing tubular into the wellbore and rotatably reengaging the first housing tubular with the second fishing tubular for removal of the apparatus and for retrieving the equipment from the wellbore. In some embodiments, the at least one apparatus may be positioned at one or more locations along a drill string, the drill string operative to lower the at least one apparatus into the wellbore.

In some embodiments, the at least one apparatus may be disconnected to separate a lower section of the drill string positioned downhole of the apparatus from an upper section of the drill string positioned uphole of the apparatus. The disconnection may comprise slowly rotating the first housing tubular in either the clockwise or counter-clockwise direction while pulling upwardly on same. The method may further comprise removing the uphole section of the drill string from the wellbore. The reconnection of the apparatus may comprise slowly rotating the first housing in either the clockwise or counter-clockwise direction while lowering same into the wellbore. Herein, the disconnection and reconnection of the apparatus may occur multiple times.

BRIEF DESCRIPTION OF THE DRAWINGS

FIG. 10C being an alternative side view of the fishing tubular (rotated 90° from 10B) showing an example guide channel, FIG. 10D showing a zoomed in view of an upper chamfer of the fishing tubular, FIG. 10E showing a zoomed in view of at least one T-shaped slot of the fishing tubular; and FIG. 10F showing a further zoomed in view of the T-shaped slot shown in FIG. 10E, collectively referred to as FIG. 10;

DETAILED DESCRIPTION OF THE PREFERRED EMBODIMENTS

According to embodiments, improved apparatus and methodologies are provided for use retrieving equipment used in the oil and gas industry from a subterranean wellbore. More specifically, the presently improved apparatus and methodologies may be used for in both disconnecting uphole equipment from downhole equipment that has become lodged or stuck within a subterranean wellbore, and then for reconnecting with the disconnected equipment to fish the equipment out of the wellbore. The presently improved apparatus comprises a modified fishing tool that, as a result of the specific geometry of the apparatus, can also serve as a separation joint, increasing the strength of the apparatus such that it can withstand the forces imposed upon downhole drilling equipment during drilling operations (e.g. withstand jarring loads during fishing operations).

The presently improved apparatus and methodologies will now be further described having regard to FIGS. 1-19.

Figure 1A:
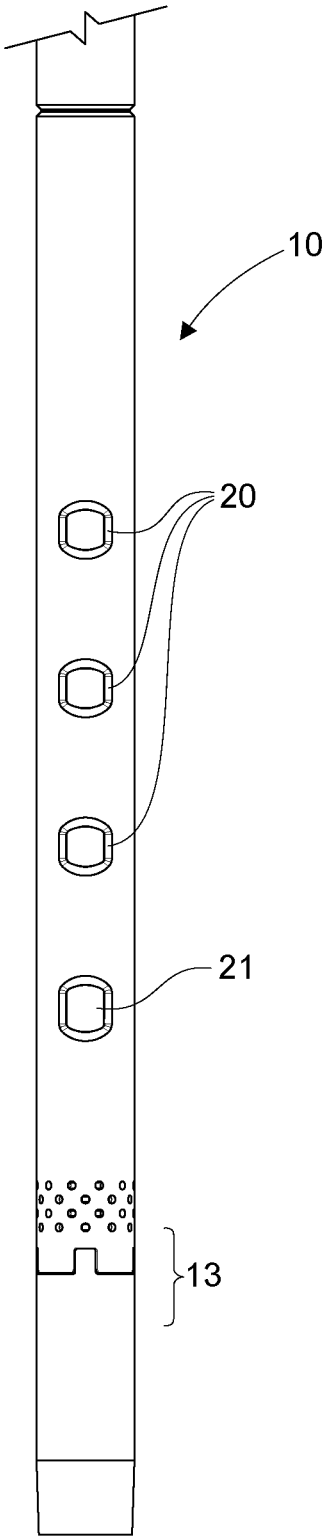
FIG. 1 shows an example of a modified apparatus according to embodiments, FIG. 1A being a perspective side view of the apparatus in a first closed (run-in) position, and FIG. 1B being a perspective side view of the apparatus in a second engaged position (with shear pins sheared)
Figure 1B:
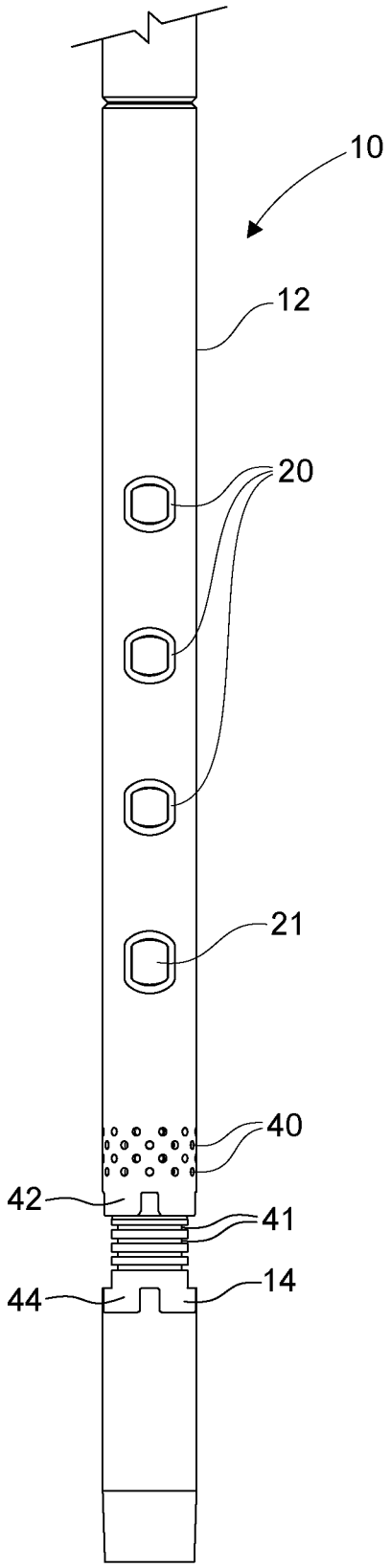
Figure 2A:
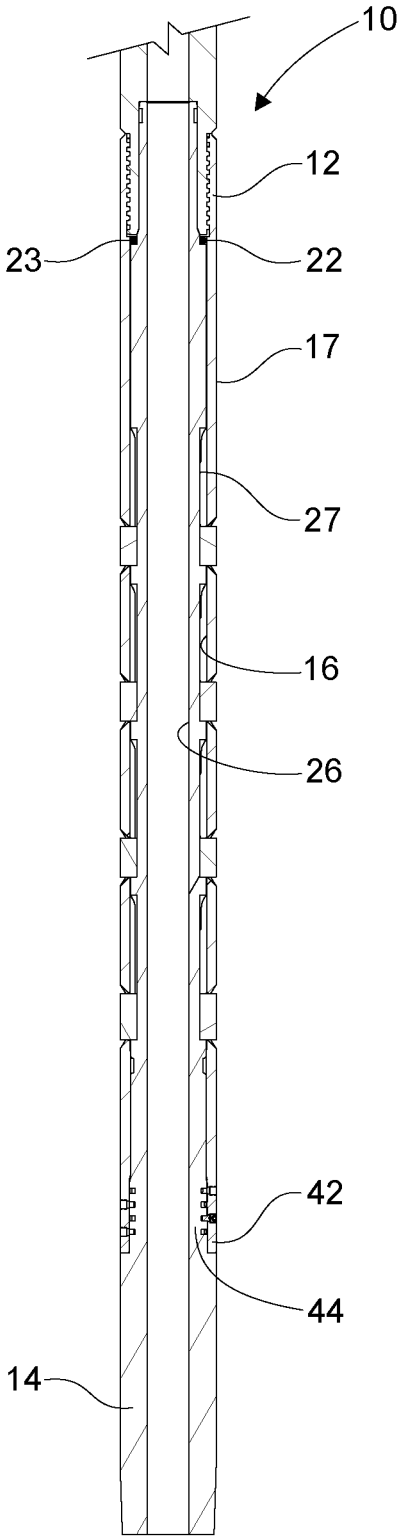
FIG. 2 shows cross-sectional side views of the apparatus of FIG. 1, FIG. 2A being a cross-sectional side view of the apparatus in the first closed position, and FIG. 2B being a cross-sectional side view of the apparatus in the second engaged position.
Figure 2B:
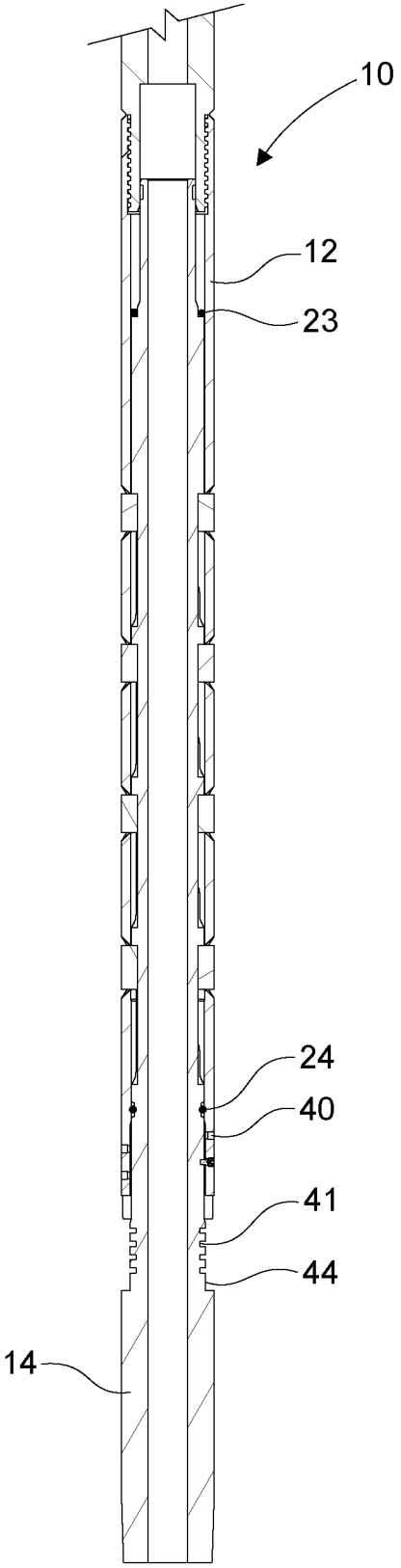

Having regard to FIGS. 1 and 2, the presently improved apparatus comprises a modified fishing tool 10 having two tubular portions 12,14 that can be easily and efficiently be disconnected and reconnected with one another. According to some embodiments, the apparatus may comprise first outer tubular 12 configured to slidably receive second inner tubular 14 therewithin. For example, apparatus 10 may generally comprise a first housing or 'sleeve' tubular 12, the housing being cylindrical in shape and having an inner surface forming a plurality of dog-teeth or lugs protruding therefrom. Apparatus 10 may generally comprise a second inner tubular, the inner tubular 14 being cylindrical in shape and having an outer surface forming a plurality of slots. As will be described in more detail, the lugs on the inner surface of the first housing tubular 12 are configured to specifically correspond to and align with the plurality of slots on the outer surface of the second inner fishing tubular 14, thereby connecting first housing and second fishing tubulars 12,14.

In some embodiments, connection between the housing and fishing tubulars 12,14 may be enhanced by at least two chamfers 34 operative, in combination with a guide channel 32 formed on the outer surface of the fishing tubular 14, to align the tubular 12,14 for easy or 'blind' interconnection of the tubulars 12,14.

In some embodiments, the apparatus 10 may further comprise a 'crown' profile 13 comprising splines 42 extending from a lower end of the housing tubular 12, said splines 42 operative to interlock with corresponding grooves 44 formed a lower end of the fishing tubular 14. Crown portion 13 may be configured to enable apparatus 10 to transfer either left-hand or right-hand torques (as will be described).

Without being limited to any specific application, the presently described apparatus 10 and methodologies may be designed for use in downhole drilling operations in the oil and gas industry, i.e. configured to transmit axial loading in both the tension and compression directions, and to transmit the high level of torque required in the normal rotational direction of the drilling equipment to which is it connected (see 'run-in' engagement; FIGS. 1A,2A). Although the apparatus 10 may be used during wellbore drilling operations in the oil and gas industry, it should be understood that such an apparatus 10 may readily be used in any application where a bore has become blocked by retrievable equipment. It should also be understood that the apparatus 10 may be readily used in other applications including, without limitation, intervention, workover and recompletion operations, and/or 'normal' fishing operations where the fishing bottom hole assembly becomes unable to detach from a fish.

Without being limited to any specific application, the presently described apparatus 10 and methodologies may be configured for use in right-hand rotation (RHR) or left-hand rotation (LHR) drill string assemblies, that is—a string assembly in which the normal direction of rotation is clockwise or counterclockwise, respectively, when viewed from above. For example, apparatus 10 may comprise either right-hand or left-hand threaded connections for connection to other components of the downhole assembly, as would be appreciated by a person skilled in the art. Herein, all reference to rotation of the string or of the present apparatus 10 is for explanatory purposes only, and is not intended to limit the scope of presently improved apparatus 10 or methodologies of use in any way.

Without being limited to any specific application, notwithstanding the normal direction of rotation of the string, apparatus 10 and methodologies of use may be configured to transmit torque applied in either the clockwise (RHR) or counterclockwise (LHR) direction from above the apparatus 10 to below the apparatus 10, that is—reverse rotation of the apparatus 10 will not risk activation of the apparatus 10 to separate string components from one another (as will be described).

According to embodiments, the present apparatus 10 may be designed for efficient disconnection of drilling equipment from downhole equipment that has become stuck within the wellbore, the disconnection being achieved in either the right-hand (clockwise) or left-hand (counter clockwise) direction, as predetermined by the operator. Once disconnection has occurred, and the drilling equipment above the lodged equipment has been salvaged, apparatus 10 may be further be used for exposure to and re-latching with the released (stuck) equipment downhole. In that regard, apparatus 10 may be configured for the dual-purpose of both separating the drill string from lodged equipment downhole and to then retrieve the lodged equipment from the wellbore. Advantageously, apparatus 10 may be released and reengaged multiple times, substantially reducing any downtime caused by a blocked wellbore. Advantageously, the present apparatus 10 may further be configured such that downhole componentry within the wellbore may be retrieved through a central bore of the apparatus 10, eliminating limitations to secondary recovery methods with conventional fishing tools. That is, apparatus 10 and methodologies of use allow for additional services such as coil tubing and wireline to travel through the internal diameter of the fishing tool 10 and further downhole in order to provide other secondary services.

Reference to terms such as "upper", "uphole", "proximal", and "above", or "lower", "downhole", "distal" or "below" or the like are used for explanatory purposes only and should not be interpreted as limiting the scope of the present apparatus and methodologies in any way. Reference to movement, rotation, or connection between one or more tool elements according to embodiments herein is for explanatory purposes and should not be interpreted as limiting the scope of the present apparatus and methodologies.

Having further regard to FIGS. 1-2, apparatus 10 comprises two main components, namely an outer 'housing' tubular (or 'sleeve') 12 and a lower 'fishing' tubular 14 (LHR, FIG. 9; RHR, FIG. 10), the two tubular 12,14 being interconnected with one another as further described. Reference made herein to one fishing tubular 14 may be made concerning either a left-hand rotation LHR or a right-hand rotation RHR embodiment of the apparatus 10.

Each of the housing and fishing tubulars 12,14 have upper and lower ends whereby, during connection of the tubulars 12,14, the lower end of the housing 12 may be configured to slidably receive the upper end of the fishing tubular 14. In some embodiments, the upper end of the housing 12 and the lower end of the fishing tubular 14 may be configured for operable connection with downhole drilling equipment within the wellbore. For example, as would be understood in the art, each of the housing and fishing portions 12,14 may be configured for threadable connection with the downhole drilling equipment (e.g. having male and/or female componentry for positioning the tool in-line within a drill string, as necessary). Threaded connections may be provided with standard API pin and socket connections, although any appropriate form of connection between adjacent downhole components might be utilized.

Figure 3A:
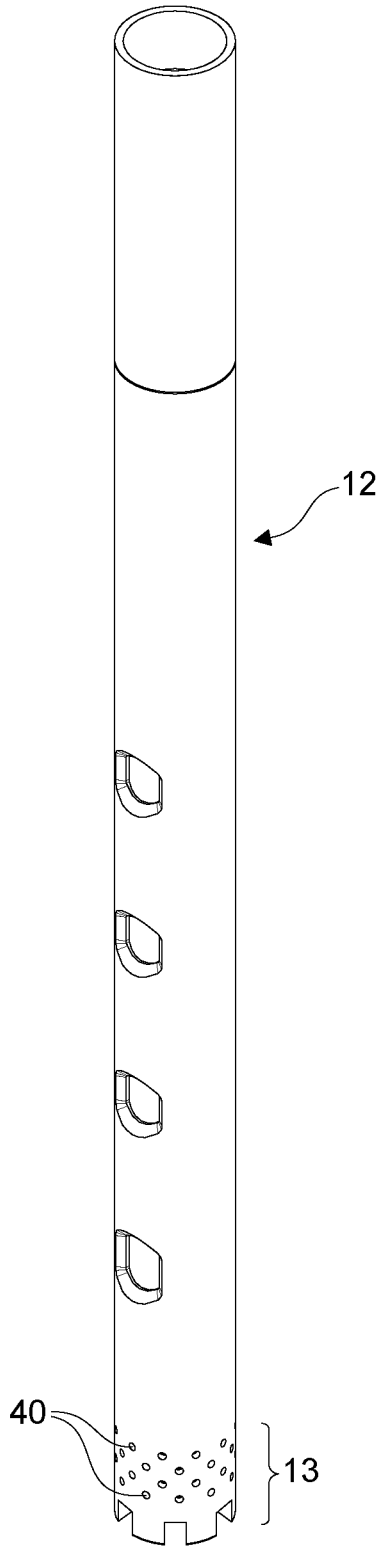
FIGS. 3A-C show an example of the housing tubular component of the present apparatus including an adapter connection component according to embodiments herein, FIG. 3A being a perspective view of the housing tubular, FIG. 3B being a side view of the housing tubular, and FIG. 3C being a cross-sectional side view of the housing tubular, collectively referred to as 'FIG. 3'.
Figure 3B:
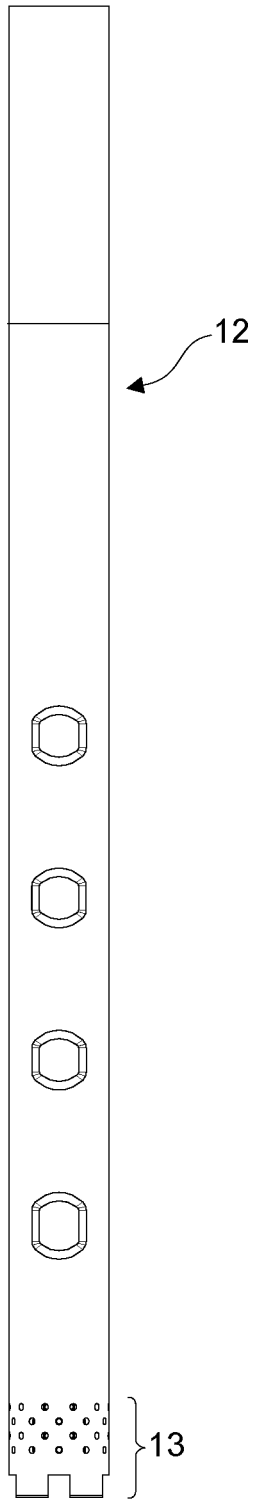
Figure 3C:
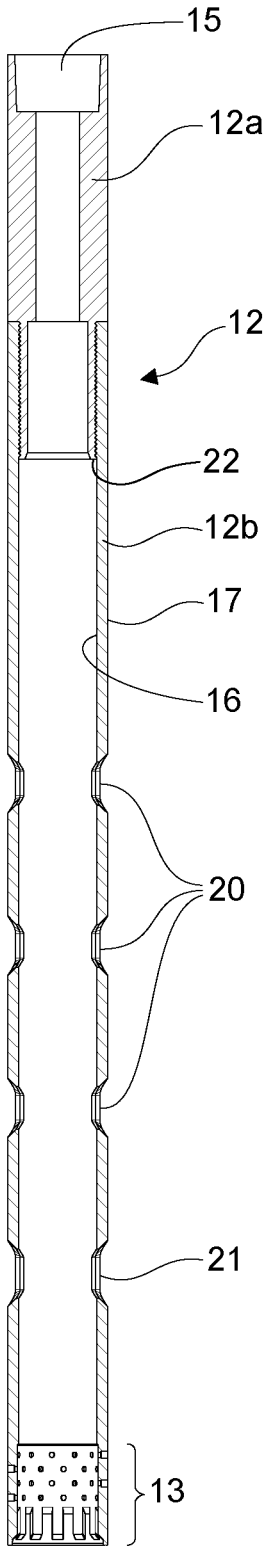
Figure 4A:
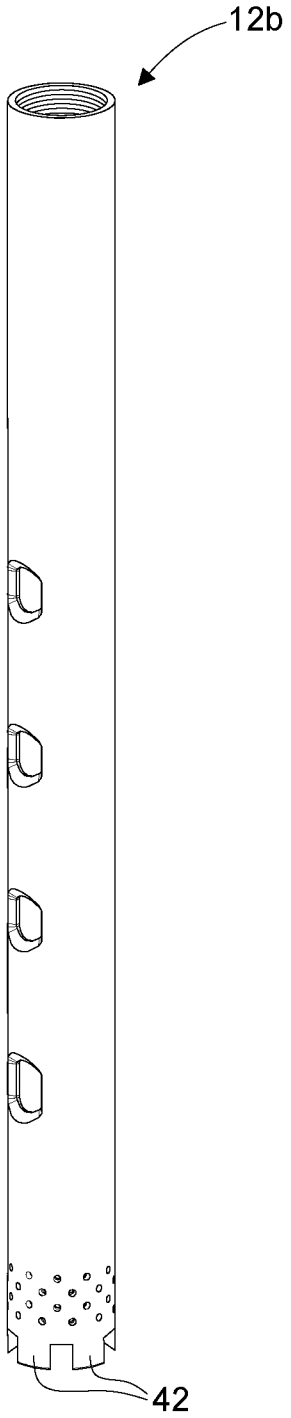
FIGS. 4A-C show an example of the housing tubular component of the present apparatus excluding an adapter connection component according to embodiments, FIG. 4A being a perspective view of the housing tubular, FIG. 4B being a side view of the housing tubular, and FIG. 4C being a cross-sectional side view of the housing tubular, collectively referred to as 'FIG. 4'.
Figure 4B:
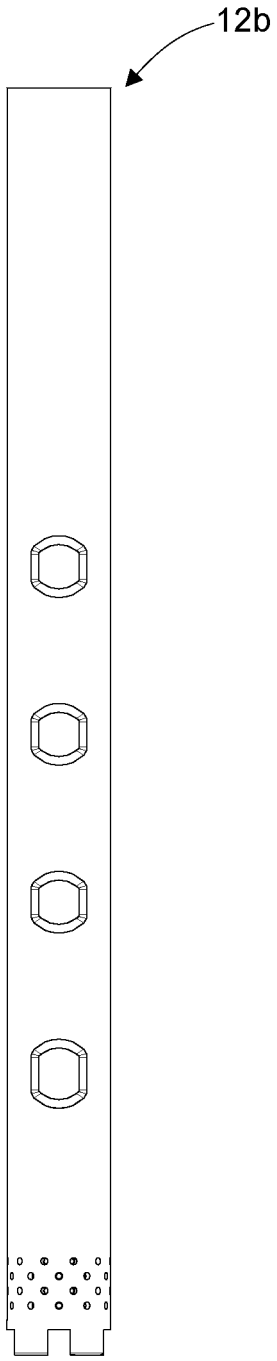
Figure 11A:
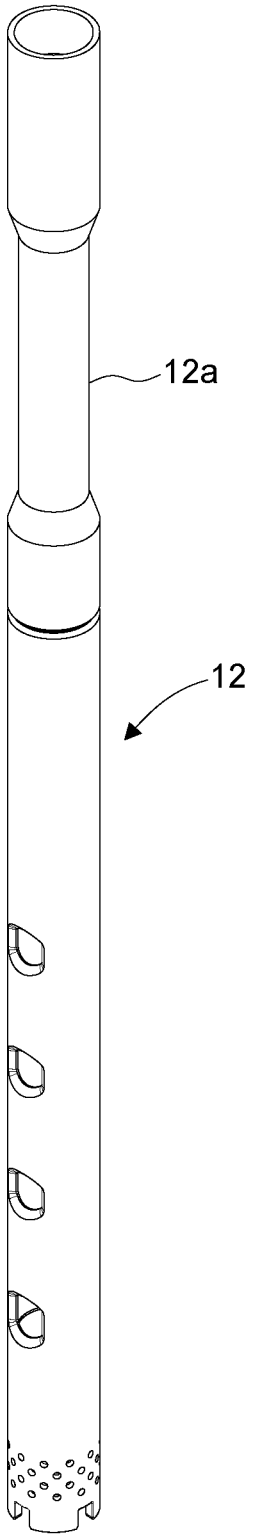
FIG. 11 shows an example of an alternative embodiment of a modified apparatus according to embodiments, the alternative embodiment having a modified adapter connection shown in FIG. 5, FIG. 11A being a perspective side view of the alternative embodiment of the present apparatus, FIG. 11B being a side view of the alternative embodiment of the apparatus, and FIG. 11C being a cross sectional side view of the alternative embodiment of the apparatus, collectively referred to as FIG. 11.
Figure 11B:
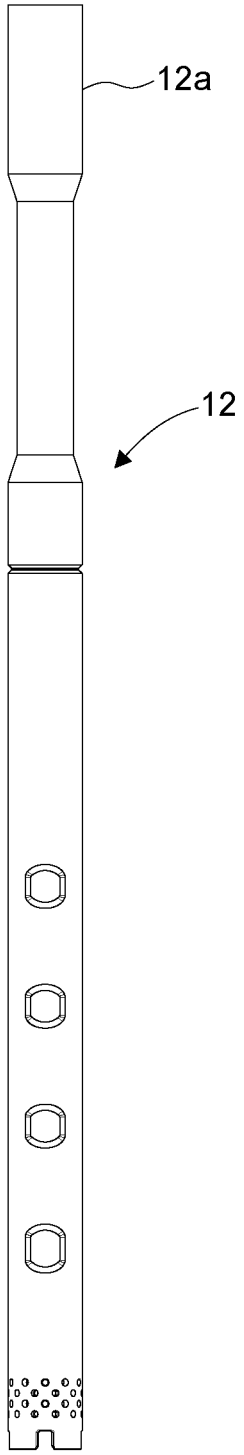
Figure 11C:
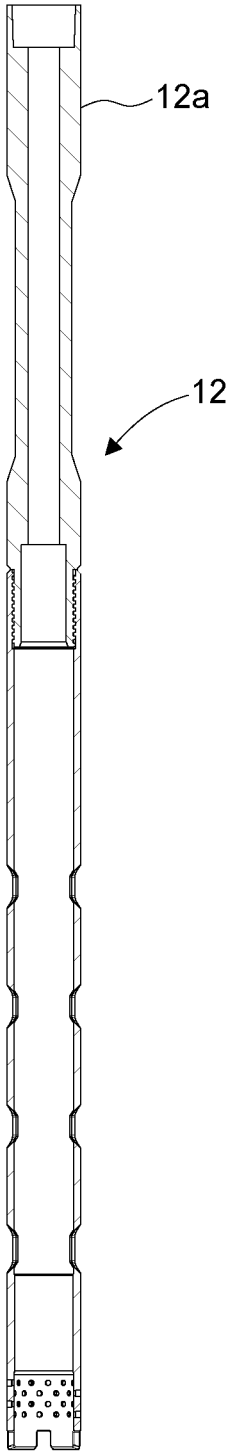

Having regard to FIGS. 3 and 4, according to some embodiments, the first housing tubular 12 may comprise one integral cylindrical body (not shown). In other embodiments, the first housing tubular 12 may comprise a first cylindrical upper 'adapter' portion 12*a* threadably connected to a second cylindrical 'sleeve' portion extending therebelow 12*b*, provided that in either configuration, housing tubular 12 forms a central bore 15 extending therethrough. FIG. 5 provides various views of first upper adapter portion 12*a*. FIG. 11 provides various views of a second, alternative embodiment of adapter portion 12*a*. Adapter 12*a* may optionally be used as an extension tubular, as desired. In some embodiments, adapter 12*a* may be configured for, inter alia, improving handling of the apparatus 10 during operation and also mitigating potential damage and/or stresses imposed on the apparatus 10 during operation, particularly where the apparatus 10 is operated in horizontal wellbores (e.g. due to 'dog-bone' shaped indentation of the adapter; FIG. 11).

Being cylindrical in shape, housing tubular 12 comprises a sidewall of substantially circular cross-section, and having an inner surface 16 and an outer surface 17, the outer surface 17 having an outer diameter in a range as would be appropriate for the particular application or use of the apparatus 10 and, in some embodiments, in the range of approximately 5¼ inches. The inner surface 16 of the housing sidewall forms the central bore 15 and may be sized to slidably receive fishing tubular 14 therein. By way of example, the central bore 15 of housing 12 may have an internal diameter in a range as would be appropriate for the particular application or use of the apparatus 10 and, in some embodiments, in the range of approximately 3.165 inches, or any other appropriate size for receiving the fishing tubular 14.

It should be appreciated that the absolute outer diameter of the apparatus 10 and the absolute internal diameter of the apparatus 10 may be specifically contemplated, such diameters configured such that the ratio of the connection elements between the tubulars 12,14 (e.g. lugs/slots as will be described) provide sufficient combined strength at least equal to or greater than the strength of any other components within the drill string. Moreover, it should also be appreciated that positioning connection means (e.g. lugs/slots 20,30) in the annular space between the housing and fishing tubulars 12,14 allows for the central bore 15 of the apparatus 10 to be sufficiently sized such that downhole drilling componentry (e.g. MWD, etc.) can be retrieved uphole through the bore 15 and that known componentry for wireline and/or coil tubing pipe recovery methods are not restricted due to inaccessibility from below the apparatus 10.

Figure 4C:
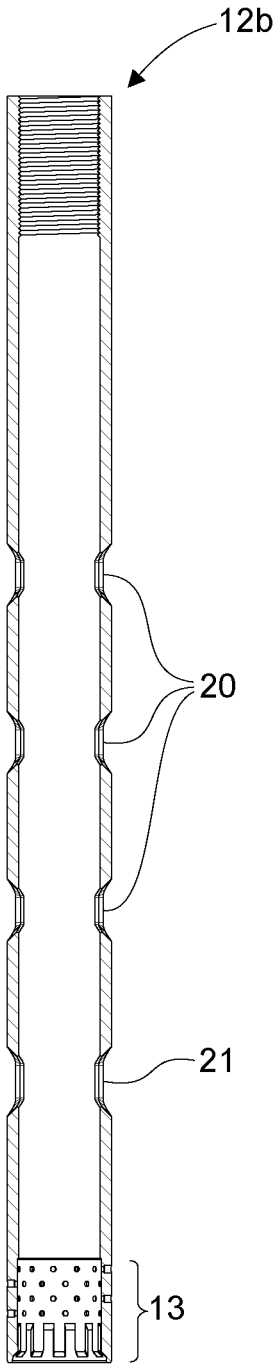
Figure 5C:
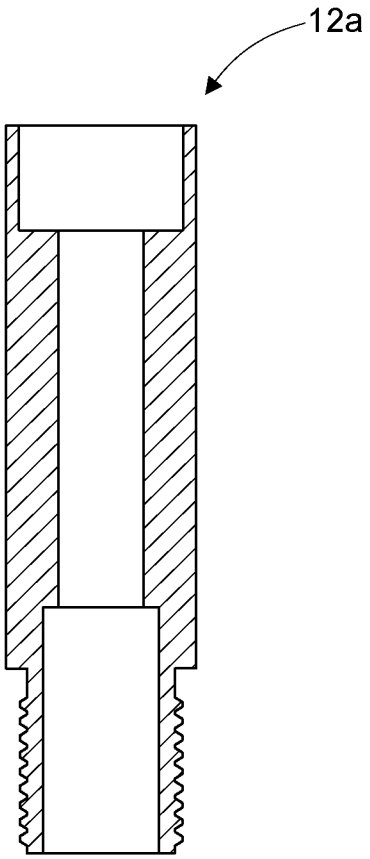
FIGS. 5A-5F show an example of the adapter connection component shown in FIG. 3, FIG. 5A being a perspective view of the adapter connection, FIGS. 5B, 5C, 5D and 5E being cross-sectional side views of the adapter connection, and FIG. 5F being a cross-section top view of the adapter connection, collectively referred to as FIG. 5.
Figure 5B:
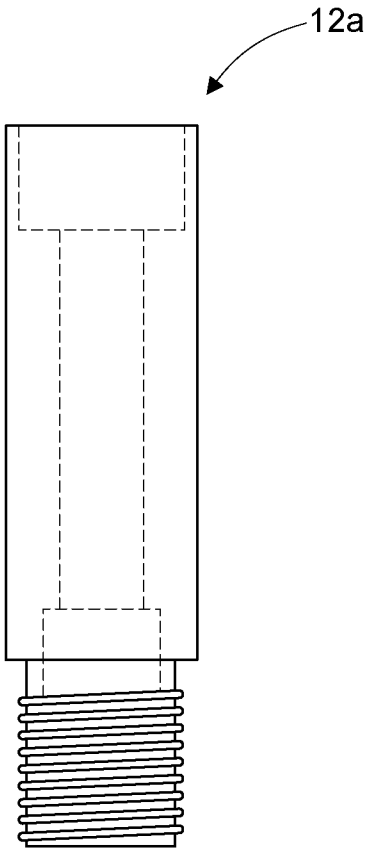
Figure 5A:
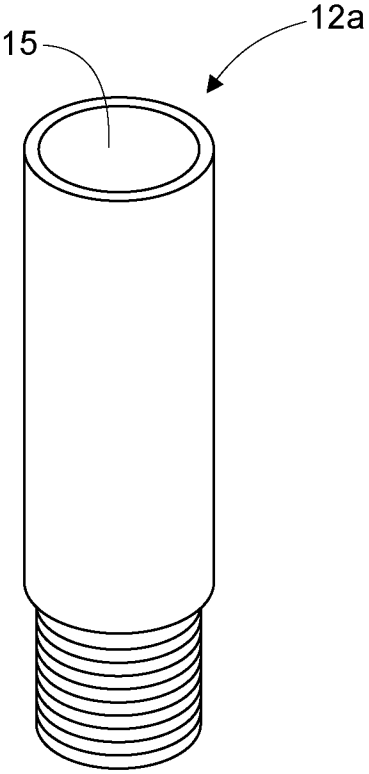
Figure 5F:
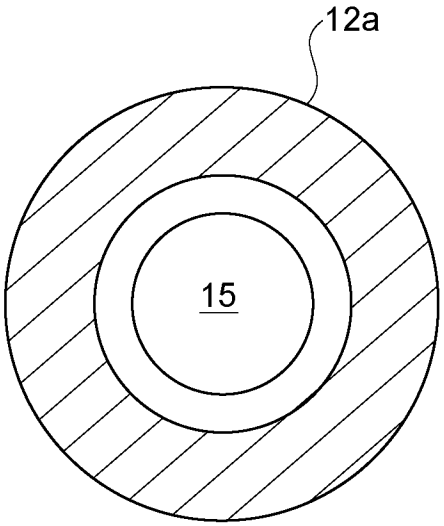
Figure 5E:
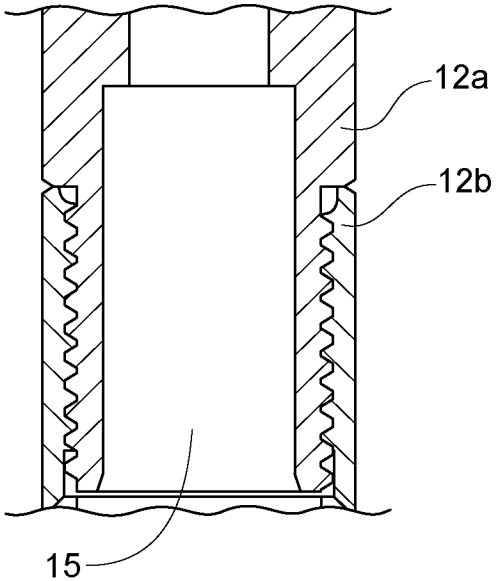
Figure 5D:
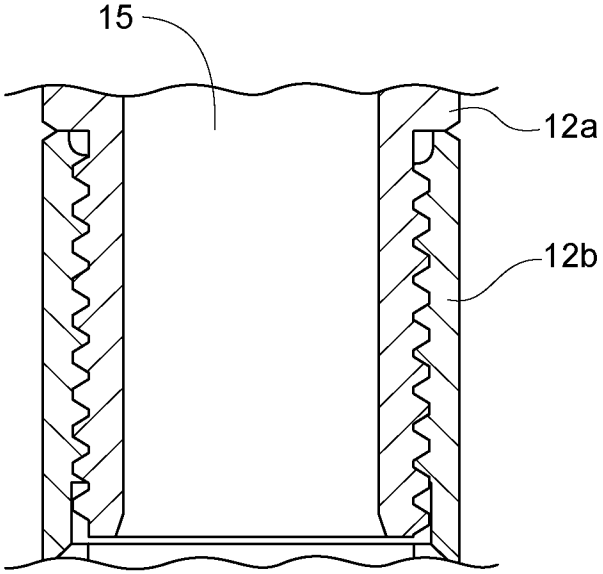
Figure 6:
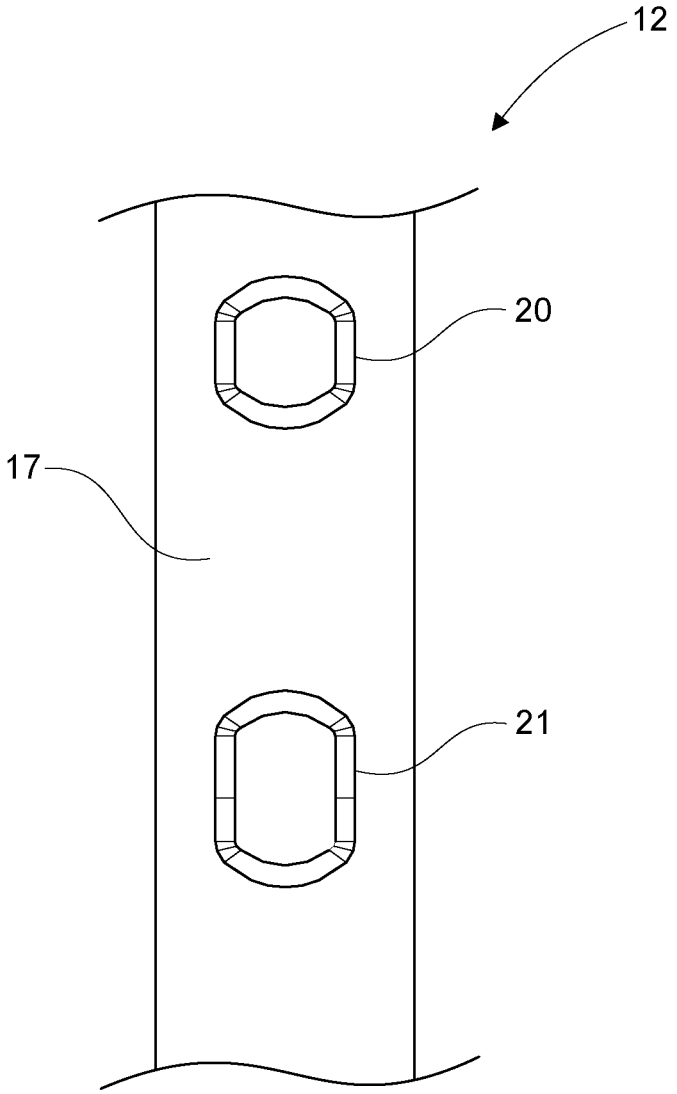
FIG. 6 shows examples of lug profiles (extending inwardly) along the outer surface of the housing tubular of the present apparatus, according to embodiments.
Figure 7A:
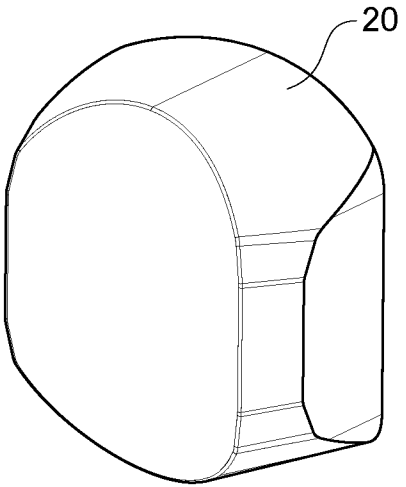
FIGS. 7A-7D show various views of a first example of a lug as shown in FIG. 6, the views being perspective, front, side, and top views of the lug profile, respectively, collectively referred to as FIG. 7.
Figure 7B:
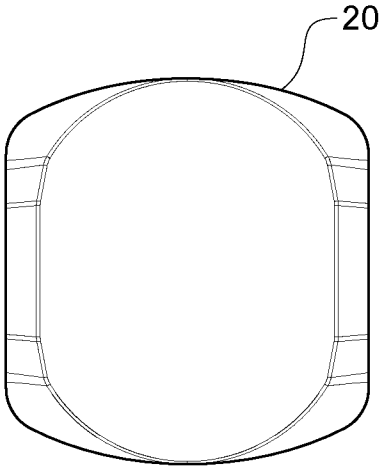
Figure 7C:
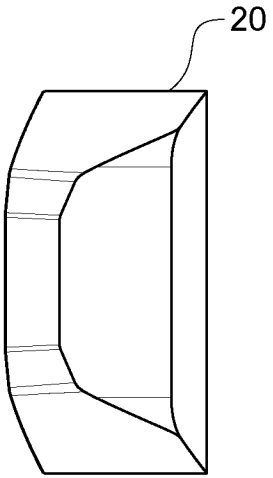
Figure 7D:
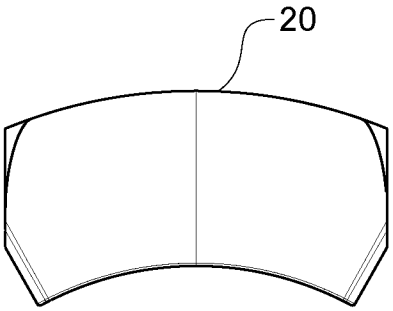
Figure 8A:
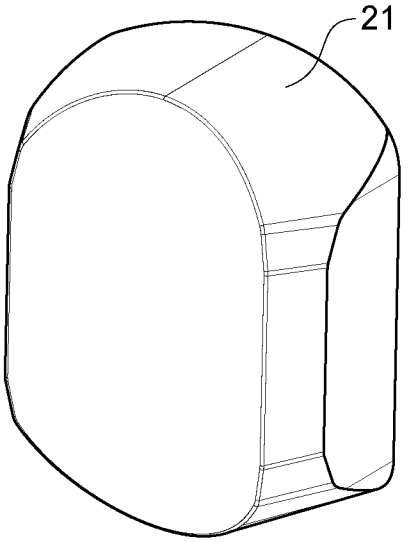
FIGS. 8A-8D show various views of a second example of a lug (e.g. a larger, longer lug) as shown in FIG. 6, the views being perspective, front, side, and top views of the lug profile respectively, collectively referred to as FIG. 8.
Figure 8B:
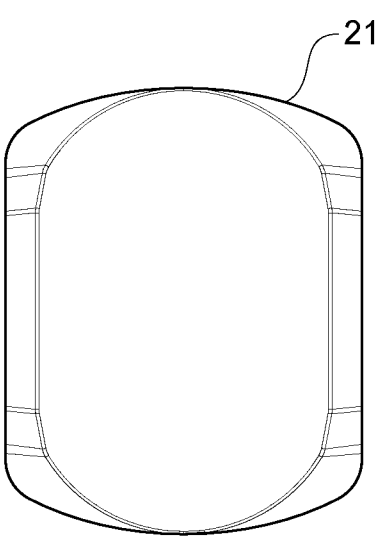
Figure 8C:
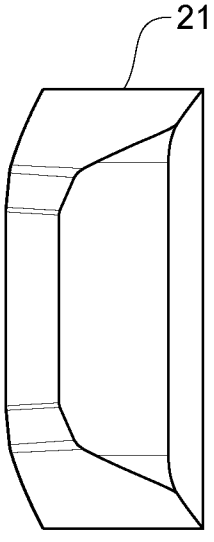
Figure 8D:
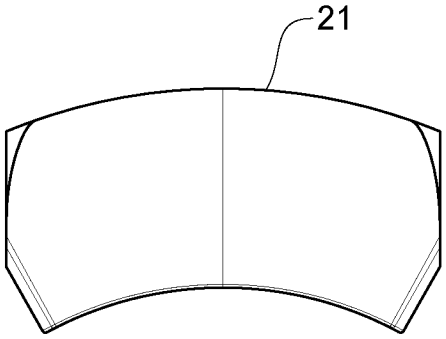
Figure 9A:
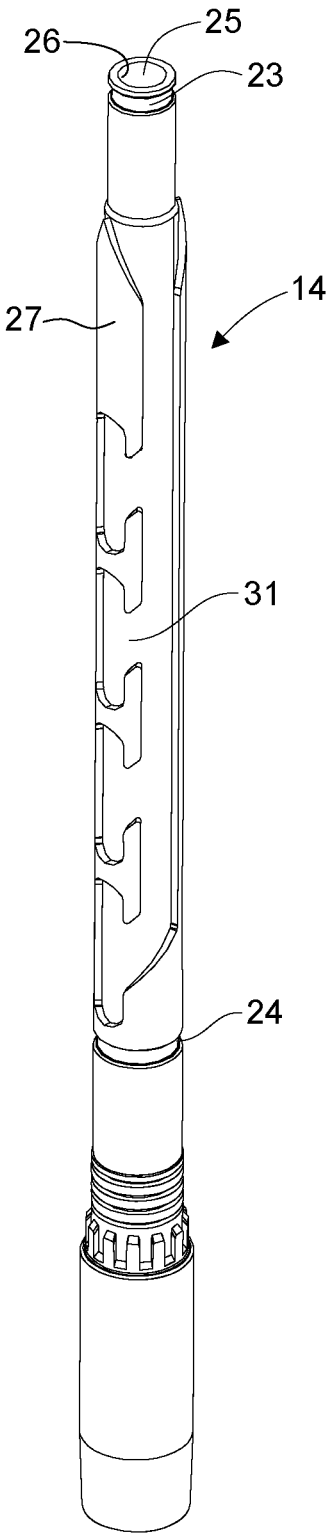
FIGS. 9A-9F show various views of the fishing tubular component of the present apparatus, the apparatus shown being configured for left-hand release, FIG. 9A being a perspective view of the fishing tubular, FIG. 9B being a side view of the fishing tubular showing examples of T-shaped slots, FIG. 9C being an alternative side view of the fishing tubular (rotated 90° from 9B) showing an example guide channel of the fishing tubular, FIG. 9D showing a zoomed in view of an upper chamfer of the fishing tubular, FIG. 9E showing a zoomed in view of an at least one T-shaped slot of the fishing tubular, and FIG. 9F showing a further zoomed in view of the T-shaped slot shown in FIG. 9E, collectively referred to as FIG. 9.
Figure 9B:
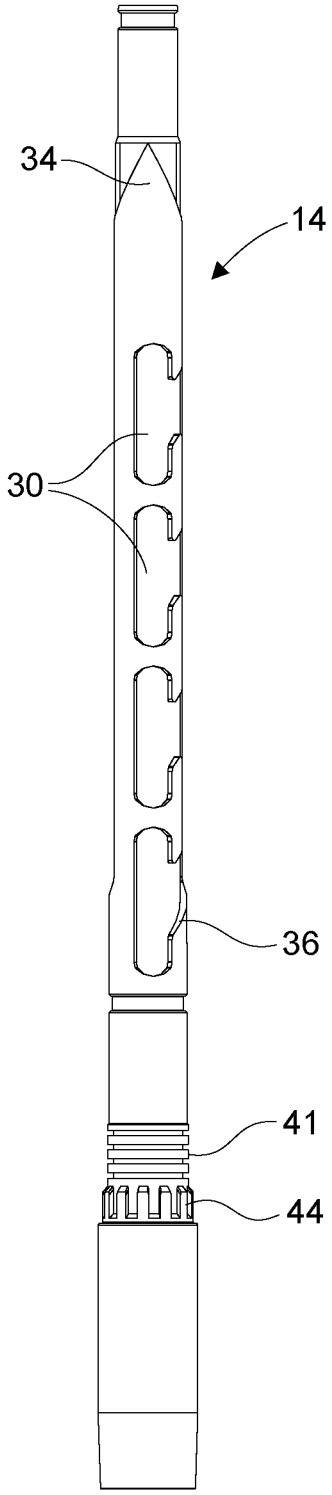
Figure 9C:
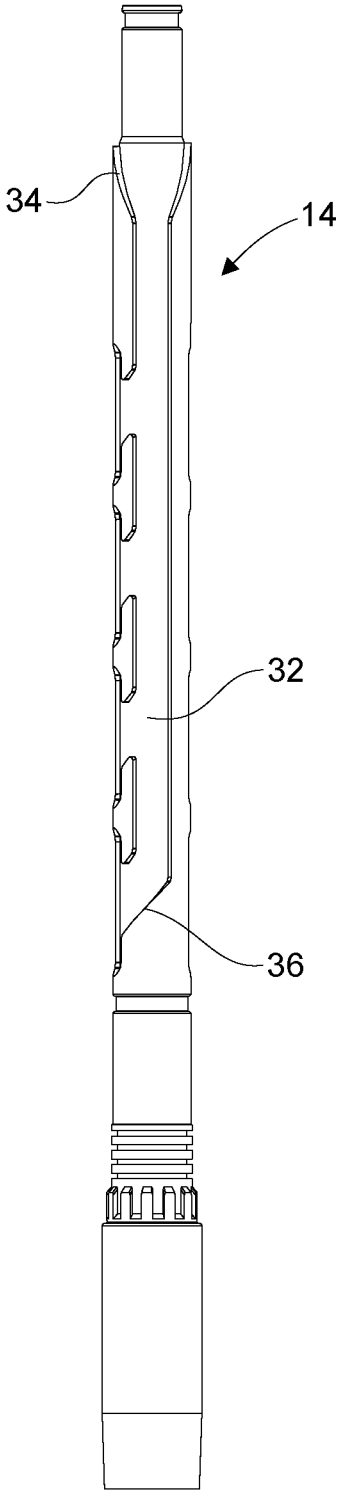
Figure 9D:
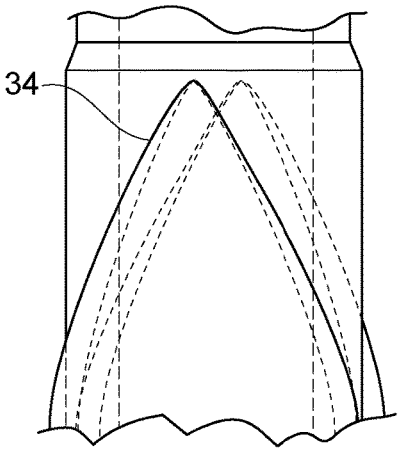
Figure 9E:
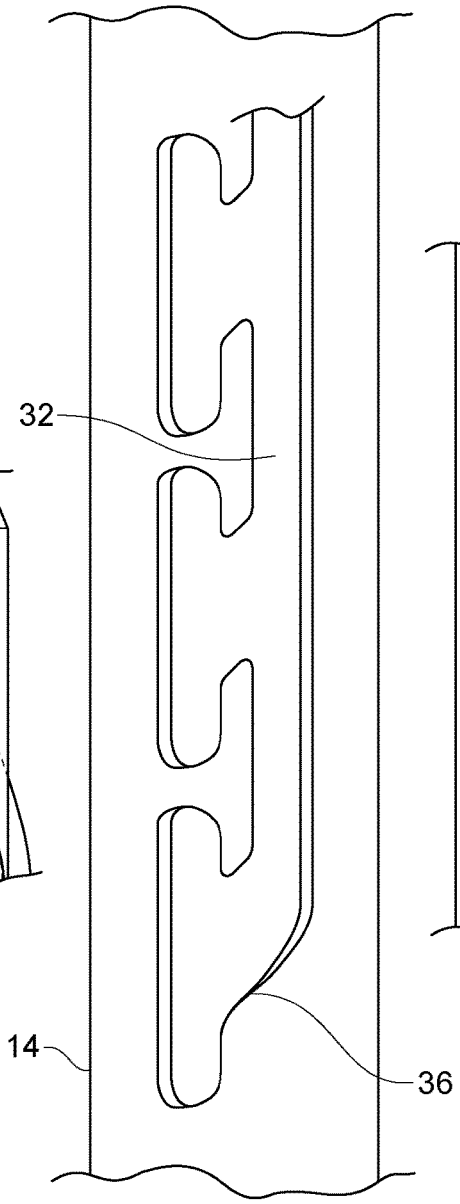
Figure 9F:
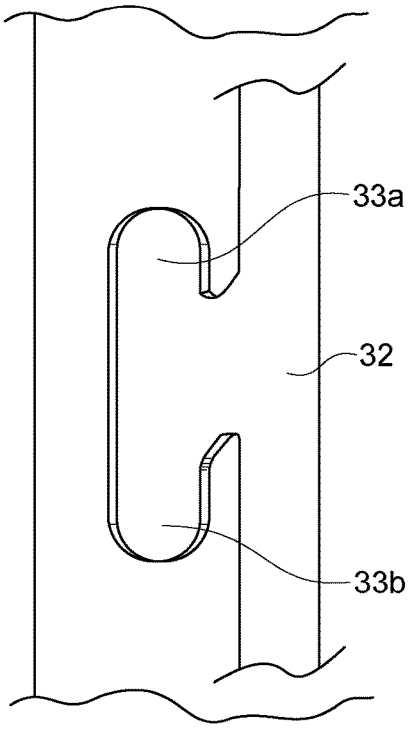
Figure 10A:
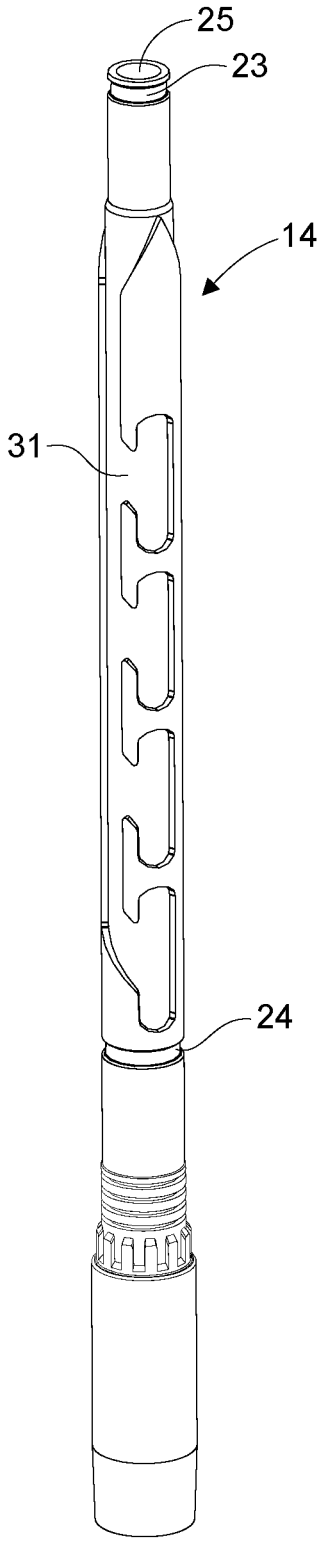
FIGS. 10A-10F show various views of the fishing tubular component of the present apparatus, the apparatus shown being configured for right-hand release, FIG. 10A being a perspective view of the fishing tubular, FIG. 10B being a side view showing examples of T-shaped slots of the fishing tubular.
Figure 10B:
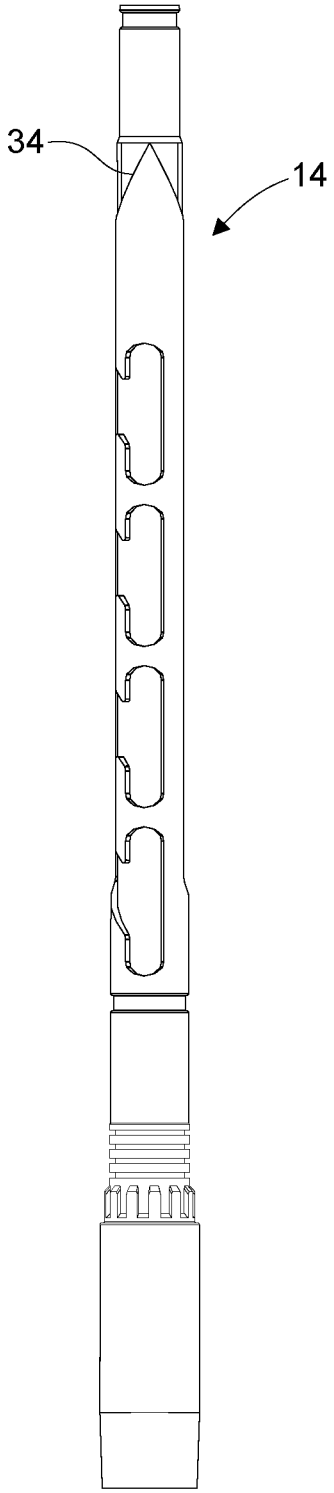
Figure 10C:
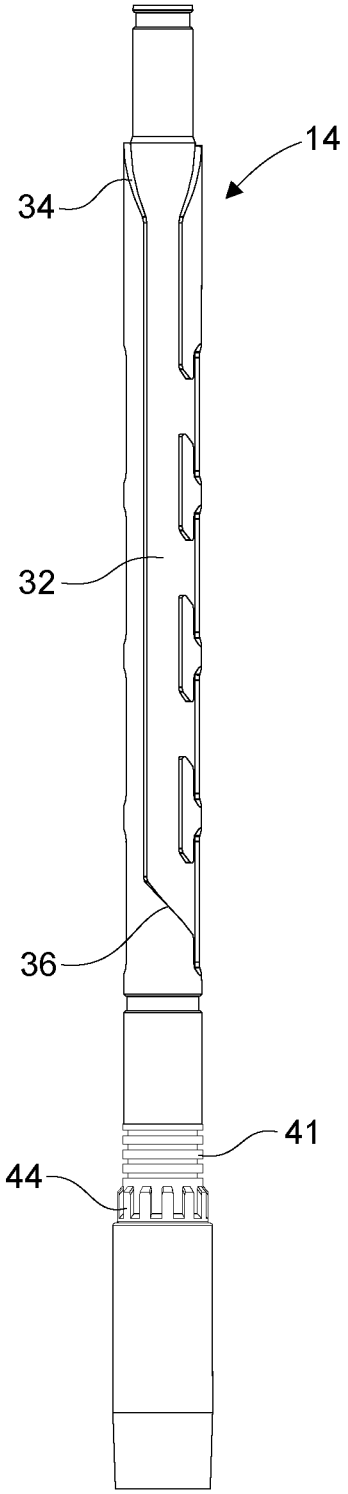
Figure 10D:
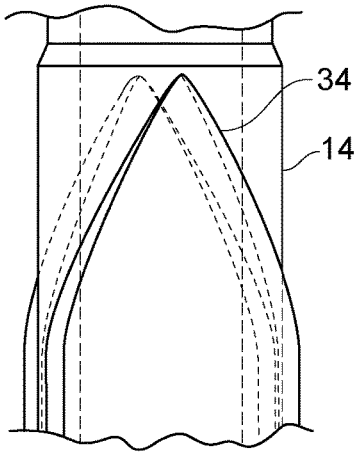
Figure 10E:
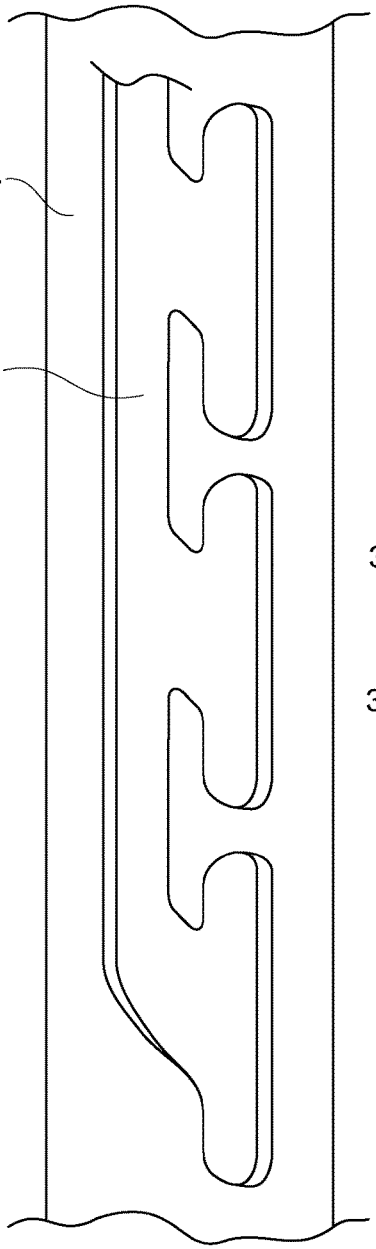
Figure 10F:
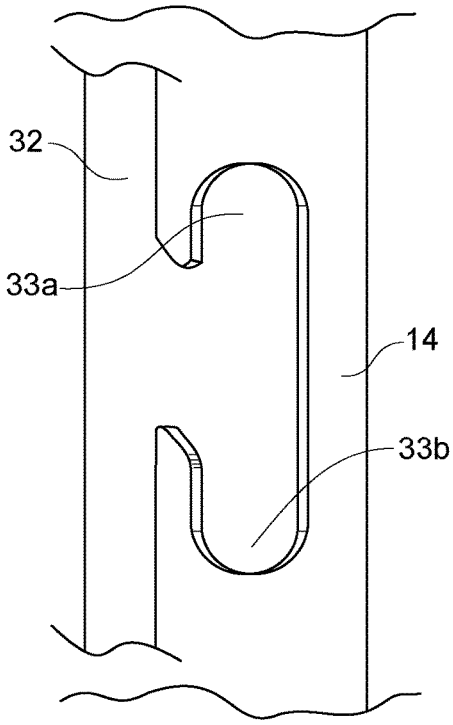

Having specific regard to FIGS. 3C and 4C depicting cross-sectional side views of housing tubular 12, inner surface 16 of the housing tubular 12 sidewall may form a plurality of radially inwardly depending protrusions or "lugs" 20 such plurality of lugs 20 being longitudinally spaced along in the inner surface 16 of the housing tubular 12 and vertically aligned one above the next (i.e. forming two diametrically-opposed rows of dog-teeth 20 aligned along a common radial plane).

In some embodiments, the plurality of lugs 20 may be generally equal in size and shape (e.g. height, length, and width, FIG. 6), save for at least one lug (see reference number 21 in FIGS. 4B and 6), which may be sized or shaped to be larger (e.g. longer in length) relative to the others (FIGS. 7 and 8). In preferred embodiments, the inner surface of the housing sidewall may comprise at least four lugs 20, whereby the lower-most lug 21 is configured to be longer in length than the other at least three lugs 20. It should be appreciated that such a configuration, wherein at least one lug 21 comprises a different size/dimension, enables the 'blind' engagement of the two tubulars 12,14 by preventing incorrect alignment the lugs 20.

In some embodiments, at or near the upper end of the housing tubular 12, the inner surface 16 of the housing tubular 12 sidewall may also form a first shoulder 22, the shoulder 22 for abutting with and preventing uphole movement of fishing tubular 14 slidably received therein. At least one upper annular seal 23 (e.g. O-ring) may provide a sealed engagement between the housing and fishing tubulars 12,14 at or near the shoulder 22, i.e. to form a fluid seal 23 within the housing tubular 12 to prevent the passage of fluid from the central bore 15 to the annular space in between the housing and fishing tubulars 12,14. Moreover, fluid seal 23 may further advantageously cooperate with a lower annular seal 24, described in more detail below, the seals 23,24 serving to act as a piston responsive to fluid pressures applied to the bore 15, such that fluid pressures may be used as a pressure assist when housing tubular 12 is pulled from the fishing tubular 14. That is—an increase in fluid pressure within the bore 15 of the apparatus 10 will assist housing tubular 12 in shearing the shear pins when housing tubular 12 disconnects from fishing tubular 14 (as will be described in more detail).

Referring now to FIGS. 9-10, in some embodiments, the fishing tubular 14 of the apparatus 10 may be configured to be slidably received within the central bore 15 of housing tubular 12. Fishing tubular 14 may also be cylindrical in shape, having a sidewall of substantially circular cross-section and having an inner surface 26 and an outer surface 27, the inner surface forming a central bore 25. It should be appreciated that the outer diameter of the fishing tubular 14 is less than the inner diameter of the housing tubular 12 such that the fishing tubular 14 may be slidingly positioned within the central bore 15 of the housing 12 in concentric arrangement, and without interference. By way of example, central bore 25 of the fishing tubular 14 may have an internal diameter as would be appropriate for the particular application or use of the apparatus 10 and, in some embodiments, in the range of approximately 2¼ inches. The inner surface 26 of the fishing tubular 14 sidewall forms a central bore 25 in fluid communication with the central bore 15 of the housing tubular 12.

According to embodiments, broadly, the outer surface 27 of the fishing tubular 14 sidewall may be specifically configured to guide the interconnection between the housing 12, with the fishing tubular 14 enabling a 'blind' connection between the tubulars 12,14, as well as to correspondingly engage and set the lugs 20,21 formed along the length of the housing 12 within slots 30 formed along the fishing tubular 14, enabling a 'locking mechanism' between the tubulars 12,14, for preventing movement therebetween. For instance, as will be described in more detail below, the outer surface 27 of the fishing tubular 14 may form both i) a guide mechanism comprising a first guide channel 32, the channel 32 being sized and shaped to slidably guide the lugs 20,21 of the housing tubular 12 as the fishing tubular 14 is slid into position within the central bore 15 of the housing tubular 12, and ii) a locking mechanism comprising a plurality of T-shaped slots 30, the slots 30 for receiving the lugs 20,21 on the housing 12 and securing them in position within the slots 30 (preventing inadvertent rotation of the tubulars 12,14 relative to each other).

Having specific regard to FIGS. 9 and 10, at its upper end, the outer surface 27 of the fishing tubular 14 may form at least one upper sloping surface or 'chamfer' 34 for directionally aligning the positioning of the upper end of the fishing tubular 14 as it is inserted into the lower end of the housing 12 (i.e. when connection between the housing tubular 12 and the fishing tubular 14 is desired either during installation and/or during a fishing operation). When the at least one upper chamfer 34 engages the lower-most lug 21 of the housing, the fishing tubular 14 caused to rotate within the housing 12 until the lugs 20,21 align with the channel 32 of the fishing tubular 14. As will become apparent, the guide channel 32 formed on the outer surface 27 of the fishing tubular 14 serves to align the tubulars 12,14 during engagement of housing tubular 12 with the fishing tubular 14, as well as to prevent inadvertent counter-rotation therebetween. Although the rotation of one tubular portion relative to the other tubular portion is described for illustrative purposes only, and is not intended to limit the scope of the presently improved apparatus 10 and methodologies of use in any way (i.e. advantageously, the housing tubular 12 may rotate relative to the fishing tubular 14, vice versa, or a combination thereof, as may be dependent upon which tubular is free to rotate).

Having further regard to FIGS. 9 and 10, at its lower end, the outer surface 27 of the fishing tubular 14 may form at least one lower sloping surface or 'chamfer' 36 for directionally guiding the positioning of the lugs 20,21 on the housing tubular 14 into engagement with the T-shaped slots 30. When the at least one lower chamfer 36 engages the lower-most lug 21 of the housing tubular 12, the fishing tubular 14 is again caused to rotate within the housing 12 causing the lugs 20,21 to enter an opening or 'mouth' 31 portion of their corresponding T-shaped slot 30 (as will be described below).

Broadly speaking, in combination, the upper chamfer 34, the guide channel 32, and the lower chamfer 36 of the fishing tubular 14 serve as a longitudinal connection guide between the housing and the fishing tubulars 12,14. In some embodiments, the outer surface 27 of the fishing tubular 14 may comprise at least two identical diametrically-opposed upper chamfers, guide channels, and lower chamfers. Accordingly, in such embodiments, the outer surface 27 of the fishing tubular 14 may form at least eight T-shaped slots 30, such slots 30 being configured in two opposed rows of four T-shaped slots 30.

Figure 12C:
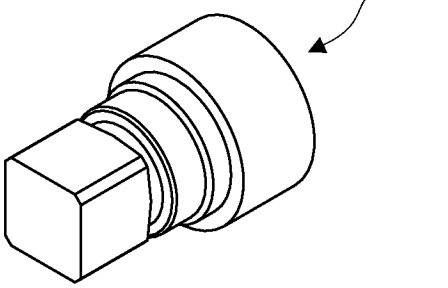
FIG. 12C showing a perspective side view of an alternative embodiment of a shear pin, collectively referred to as FIG. 12.
Figure 12B:
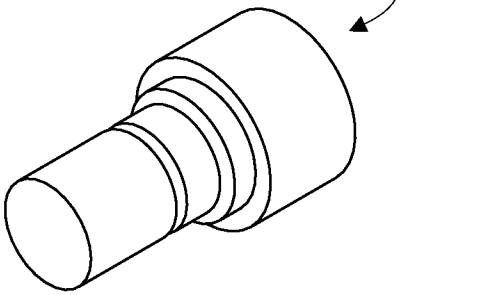
FIG. 12 shows an example of a shear pin according to embodiments, FIG. 12A showing a cross sectional side view of a shear pin positioned within a pin hole, FIG. 12B showing a perspective side view of a first embodiment of a shear pin.
Figure 12A:
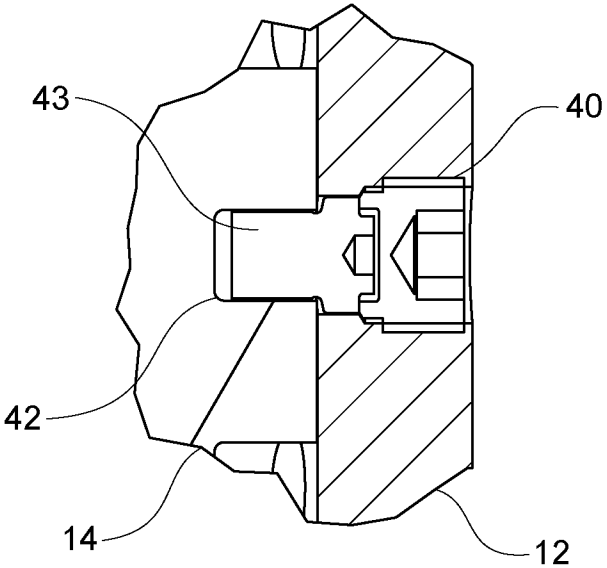
Figure 13A:
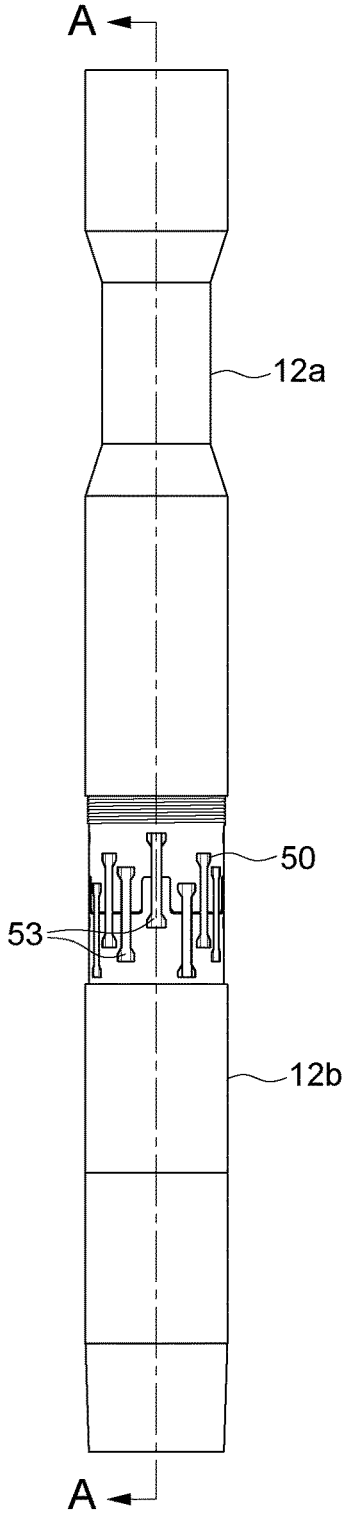
FIG. 13 shows an example of an alternative embodiment of a shear pin configuration, according to embodiments, FIG. 13A showing a side view of a plurality of shear pins positioned within pin holes, FIG. 13B showing a cross-sectional side view of the shear pins shown in FIG. 13A (along lines A-A), and FIG. 13C showing a perspective view of the shear pins shown in FIG. 13A, collectively referred to as FIG. 13.
Figure 13B:
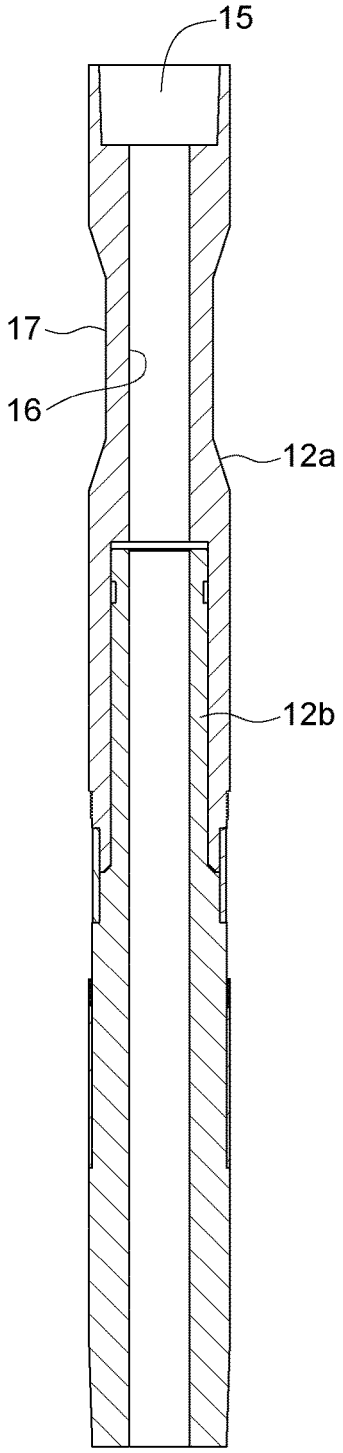
Figure 13C:
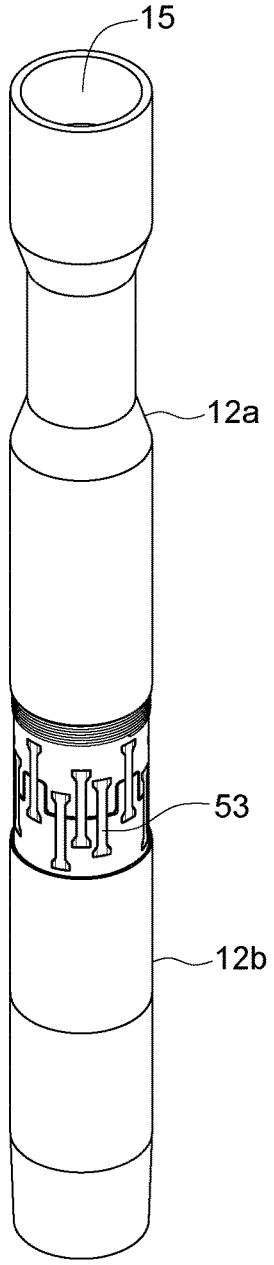
Figure 14A:
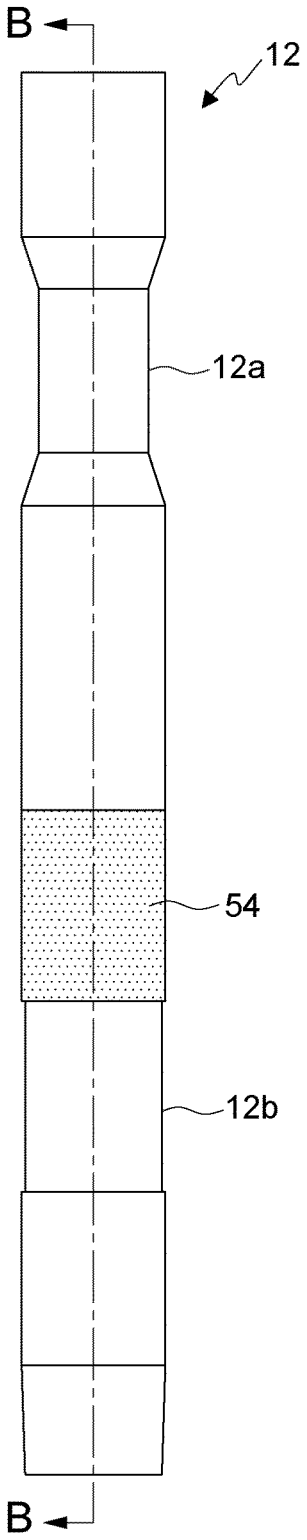
FIG. 14 shows an example of the alternative embodiment of the shear pin configuration shown in FIG. 13, FIG. 14A showing a side view of the housing tubular with protective plate in position to cover shear pins, FIG. 14B showing a cross-sectional side view of the housing tubular shown in FIG. 14A (along lines B-B), and FIG. 14C showing a perspective view of the housing tubular shown in FIG. 14A, collectively referred to as FIG. 14.
Figure 14B:
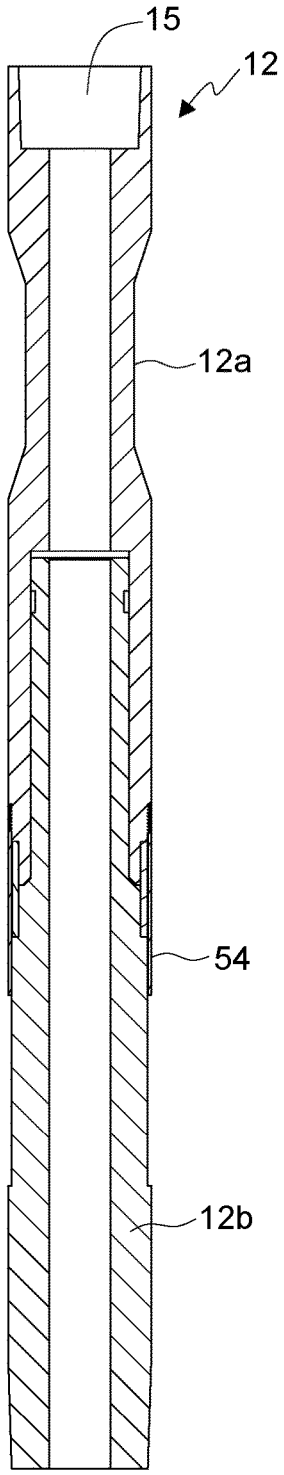
Figure 14C:
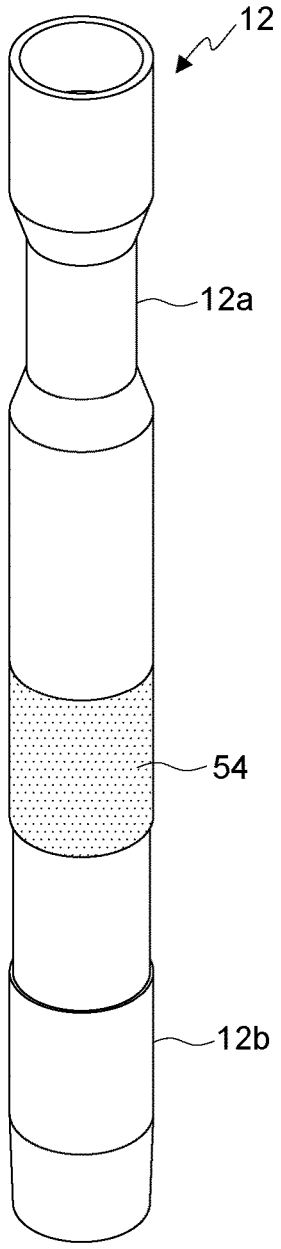

According to embodiments, having regard to FIG. 12, the lower end of the housing tubular 12 may further comprise a plurality of radially spaced shear pin holes 40 for receiving a plurality of shear pins 43 therethrough. The lower end of the fishing tubular 14 may form a plurality of shear pin grooves 41, the grooves 41 comprising a plurality of axially spaced, annular rows corresponding with shear pin holes 40 such that pins 43 receiving through the pin holes 40 extend into and communicate with the grooves 41 of the fishing tubular 14. As would be appreciated in the art, the shear pins 43 may be of any appropriate size or configuration (for example see FIGS. 12B,12C) provided that pins 43 may be sheared by a predetermined upward force imposed upon the housing tubular 12, such shearing methods comprising a mechanical method, a hydraulic method, or a combination thereof.

As would also be appreciated, the number, size and location of shear pins 43 may be predetermined and configured as desired by a person skilled in the art for the particular application of the apparatus 10. At least one lower annular seal groove may be provided for receiving at least one lower annular seal 24 (e.g. O-ring) to provide a sealed engagement between the housing and fishing tubulars 12,14 at or near the shear pins 43, i.e. to form a second fluid seal within the housing tubular 12 to prevent the passage of fluid from the central bore of the apparatus 10 to the annulus between the housing and fishing tubulars 12,14. As above, seals 23,24 may further serve to act as a piston responsive to fluid pressures applied within central bore, such that fluid pressures may be used as a pressure assist when the housing tubular 12 is pulled from the fishing tubular 14.

According to embodiments, having regard to FIGS. 13-19, an alternative embodiment of the shear pins may be provided. Having specific regard to FIG. 13, as above, the housing tubular 12 may comprise an upper adapter portion 12*a* and a lower sleeve portion 12*b*. In some embodiments, upper and lower portions 12*a*,12*b*, of the housing tubular 12 may be configured to provide an alternative shear pin embodiment, wherein the full shear pin embodiment is formed in the sidewall of the housing tubular 12.

For example, in some embodiments, upper and lower portions of the housing tubular 12*a*,12*b* may be configured to form a plurality of radially spaced, longitudinally-extending shear pin holes 50. Slots 50 may be radially spaced around the circumference of the outer surface 17 of the housing tubular 12. Pin holes or slots 50 may be formed within the sidewall of the housing tubular 12, but may not extend all the way therethrough (see FIG. 18D).

In some embodiments, pin holes 50 may be dog-boned shaped slots for receiving correspondingly shaped shear pin 53 therein. Having regard to FIG. 14, one or more protective plates or sleeves 54 may be positioned to cover the shear pins 53, preventing pins 53 from exposure to the downhole wellbore environment. Having regard to FIG. 17, protective plate 54 may comprise a tubular sleeve, or the like.

Figure 15A:
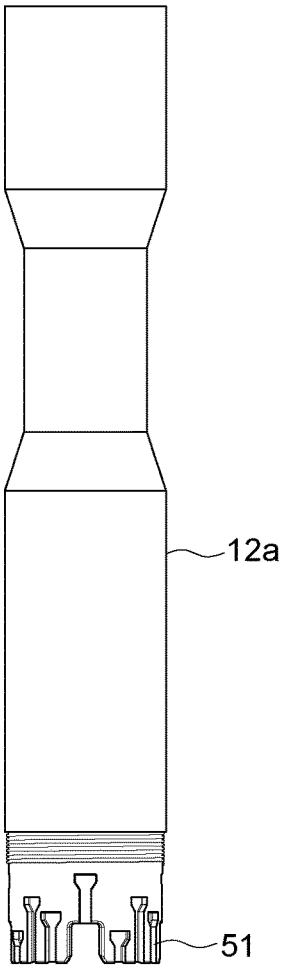
FIG. 15 shows an example of the upper housing portion of the alternative shear pin configuration shown in FIGS. 13 and 14, FIG. 15A showing a side view of the upper housing portion, and FIG. 15B showing a cross-sectional top view of the upper housing portion shown in FIG. 15A, collectively referred to as FIG. 15.
Figure 15B:
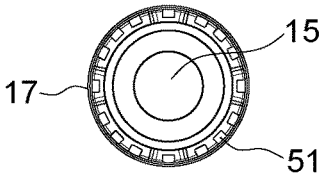
Figure 16A:
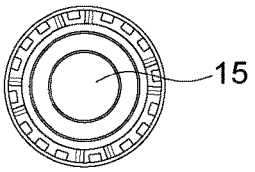
FIG. 16 shows an example of the lower housing portion of the alternative shear pin configuration shown in FIGS. 13 and 14, FIG. 16A showing a cross-sectional top view of the lower housing portion shown in FIG. 16B, and FIG. 16B showing a side view of the lower housing portion, collectively referred to as FIG. 16.
Figure 16B:
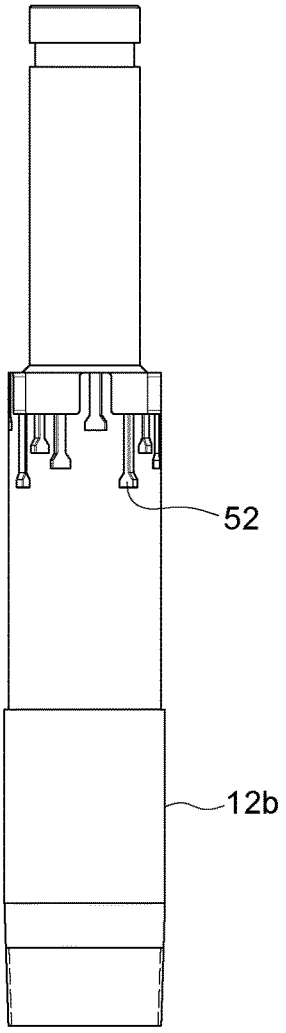
Figure 17A:
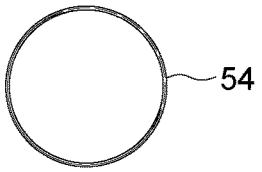
FIG. 17 shows an example of the protective plate shown in FIG. 14, FIG. 17A showing a cross-sectional top view of the plate, and FIG. 17B showing a side view of the plate.
Figure 17B:
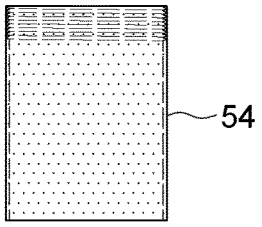
Figure 18A:
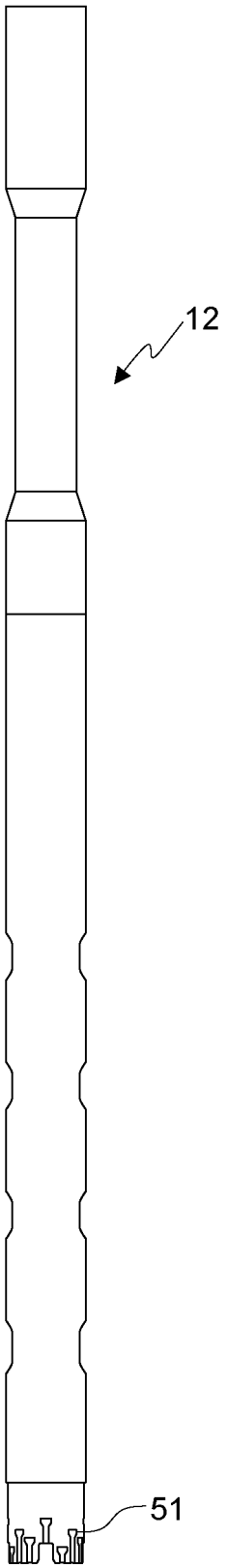
FIG. 18 shows an example of a further alternative embodiment of a shear pin configuration, according to embodiments, FIG. 18A showing a side view of the housing tubular forming a plurality of shear pin holes (upper half only)
FIG. 18B shows a zoomed in side view of the shear pin holes shown in FIG. 18A.
FIG. 18C shows a cross-section top view of the housing tubular shown in FIG. 18B (taken along lines C-C)
FIG. 18D shows a cross-sectional side view of the housing tubular shown in FIG. 18B (taken along lines D-D); collectively referred to as FIG. 18.
Figure 18B:
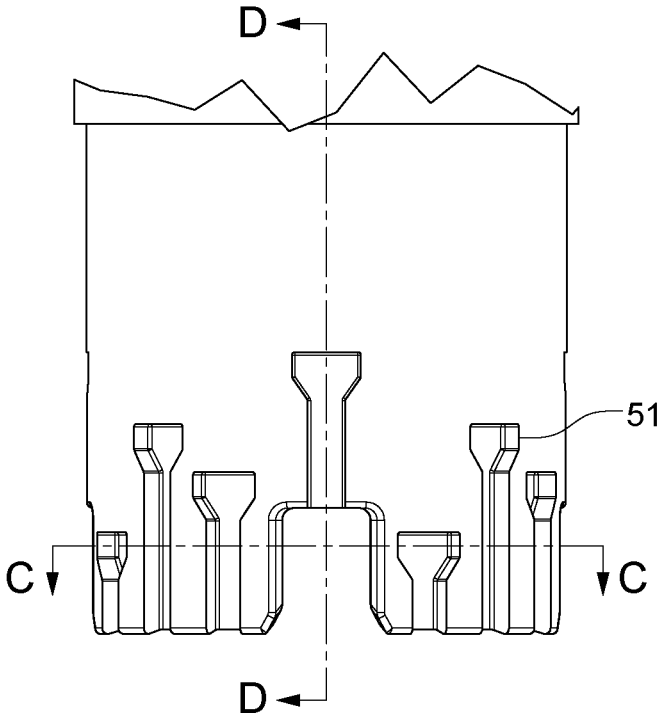
Figure 18C:
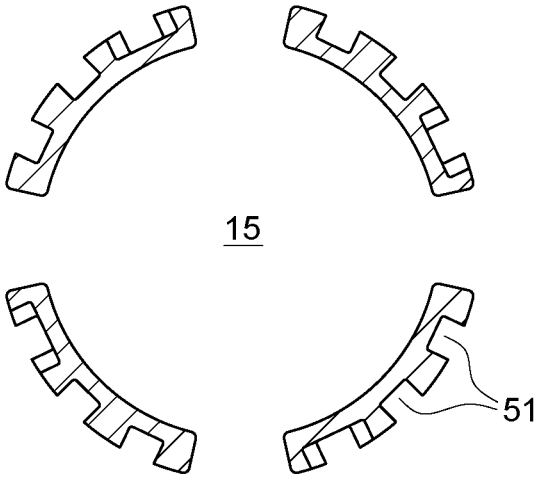
Figure 18D:
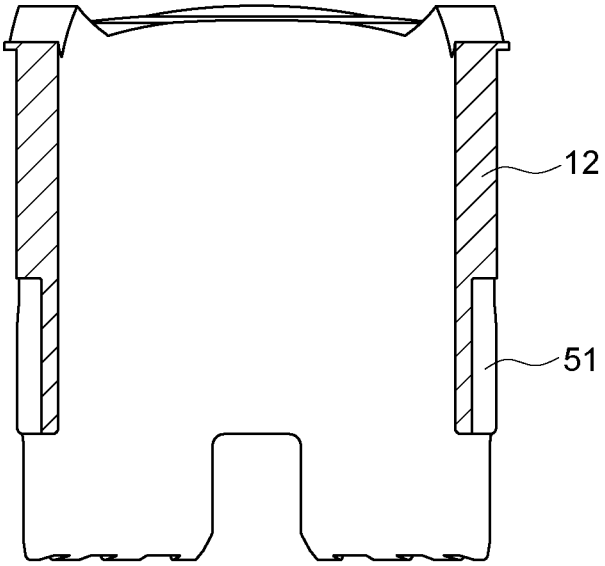

Having regard to FIG. 15, the upper portion of the housing tubular 12*a* may be configured to form a first upper half of the dog-bone shaped pin hole 51 (FIG. 15A), while the lower portion of the housing tubular 12*b* may be configured to form a second, corresponding lower half of the dog-bone shaped pin hole 52 (FIG. 16B). Lower portion of housing tubular 12B may further be configured to be slidably received within the central bore of upper portion of housing tubular 12A, such that, when in position, upper pin hole portions 51 align with lower pin hole portions 52 to form a complete shear pin hole or slot 50 for receiving pins 53. Having regard to FIG. 18, in other embodiments, the lower end of the housing tubular 12 may be configured to form the first upper half of the dog-boned shaped pin hole 51, i.e. it is understood that shear pin component of the present apparatus 10 may be positioned anywhere along the housing tubular 12, as would be appreciated in the art.

Figure 19A:
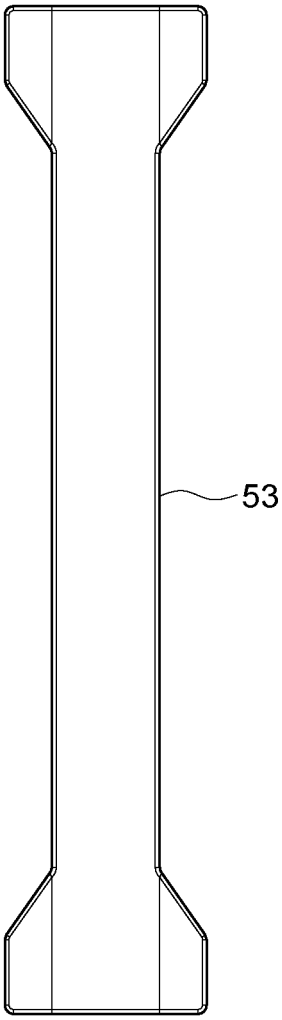
FIG. 19 shows an example of an alternative embodiment of a shear pin, according to embodiments, FIG. 19A showing a front view of a shear pin, FIG. 19B showing a side view of a shear pin.
FIG. 19C showing a top view of a shear pin, collectively referred to as FIG. 19.
Figure 19B:
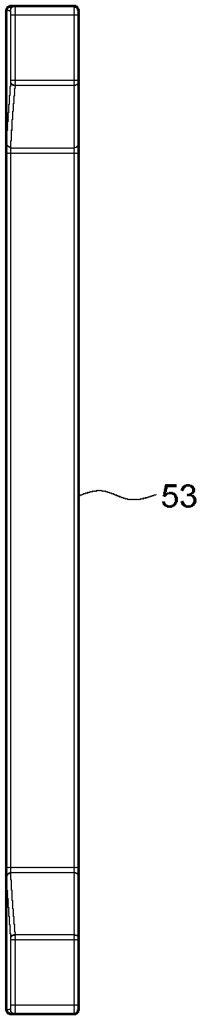
Figure 19C:
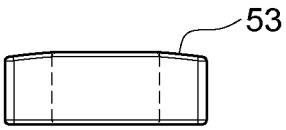

Having regard to FIG. 19, as would be appreciated in the art, the shear pins 53 may be of any appropriate size or configuration provided that pins 53 may be sheared by a predetermined upward force imposed upon the housing tubular 12, such shearing methods comprising a mechanical method, a hydraulic method, or a combination thereof. As would also be appreciated, the number, size and location of shear pins 53 may be predetermined and configured as desired by a person skilled in the art for the particular application of the apparatus 10.

According to embodiments, and as referred to herein as the 'crown profile' 13, the lower end of the housing tubular 12 may further be configured to form a plurality of axially extending splines 42, and the lower end of the fishing tubular 14 may further be configured to form opposed, axially indented grooves or notches 44 for correspondingly engaging with the splines 42. In some embodiments, the plurality of splines 42 may be equally-spaced substantially rectangular 'keys' for fitting into the correspondingly equally-spaced notches on the fishing tubular 14. It should be understood that the present 'crown' profile engagement 13 between the housing tubular 12 and the fishing tubular 14 may be any corresponding configuration so as to enable and ensure accurate axial positioning between the two tubulars 12,14 during connection. Moreover, it should also be understood that the present 'crown' profile engagement 13 further enhances the amount of axial torque transmittable from above the apparatus 10 to below the apparatus 10, thereby strengthening the overall transmission of torque in either the right-hand or left-hand directions downhole.

CONNECTION—Broadly, connection between the two tubulars 12,14 of the apparatus 10 may be desired during installation for positioning of the apparatus 10 within the drill string, or during a fishing operation when the fishing tubular 14 has been separated from the housing 12 and re-connection of the tubulars 12,14 must occur to retrieve the separated equipment lodged downhole (as will be described). Advantageously, the present apparatus 10 is specifically configured to provide a connection guide between the housing tubular 12 and the inner fishing tubular 14, enabling easy 'blind' connection or reconnection of the fishing tubular 14 within the housing tubular 12. It is contemplated that one or more of the present apparatus 10 may be used or 'run in' in a single drill string.

Having regard again to FIGS. 9 and 10, the outer surface 27 of the fishing tubular 14 forms a plurality of axially indented slots 30 extending longitudinally along the length of the fishing tubular 14 sidewall and between the upper and lower chamfers 34,36, each slot 30 forming an opening or 'mouth' portion 31 in communication with the guide channel 32. Each plurality of slots 30 may be sized, shaped, and spaced to correspondingly receive and engage with one of the plurality of lugs 20,21 formed on the inner surface 16 of the housing tubular 12 sidewall, as the fishing tubular 14 is slidably received within the central bore 15 of the housing tubular 12. In some embodiments, the plurality of slots 30 may be T-shaped slots, each slot 30 having a mouth portion 31 for guiding the lugs 20,21 into and out of the slot 30 (i.e. to and from the guide channel 32), and having a channel portion, the channel of each slot 30 being substantially perpendicular to its mouth portion 31 (i.e. to form a T-shape). The channel portion of each slot 30 may form uphole and downhole terminal stops 31*a*,*b*, respectively (FIG. 9F,10F) uphole and downhole descriptors being relative to the mouth portion 31, respectively.

As described above, the 'locking mechanism' between the housing and the fishing tubulars 12,14 arises when the lower-most lugs 21 on the housing tubular 12 engages the lower chamfer 36, the lug 21 (and all vertically aligned corresponding lugs 20) is guided into the mouth portion 31 of the T-shaped slot 30, rotating the fishing tubular 14 relative to the housing tubular 12. Rotation of the tubulars 12,14 causes the lugs 20,21 to enter the T-shaped slots 30, and to continue downwardly into the downhole terminal stop 33*b* within the slot channel. As such, during connection of the housing and fishing tubulars 12,14, lugs 20,21, travel downwardly from the upper chamfer 34, into the guide channel 32 until the lower-most lug 21 is guided by the lower chamfer 36 such that each lug 20,21 enters the mouth portion 31 of a corresponding T-shaped slot 30 and finally downwardly into the downhole terminal stop 33*b* of the slot 30. Positioning of the lugs 20,21 in the downhole stop 33*b* for the T-shaped slot 30 locks the tubulars 12,14 in place, ceasing movement of the tubulars 12,14 relative to one another, i.e. connection of the housing and fishing tubulars 12,14 serves to prevent movement (rotational or longitudinal) between the housing tubular 12 and the fishing tubular 14. That is, as would be understood, due to the geometrically predetermined number, shape, and positioning slots 30 along the outer surface 27 of the fishing tubular 14 engaging the lugs 20,21 along the inner surface 16 of the housing tubular 12, improper interconnection between the is prevented (i.e. by design, lugs 20,21 are prohibited from improperly or inadvertently engaging non-designated slots 30).

Although T-shaped slots are described as the present locking mechanism between the tubulars 12,14, it should be readily apparent that any suitable configuration known in the art is contemplated, provided that the locking mechanism is further designed to maximize the interface (i.e. surface contact) between the tubulars 12,14, preventing deformation of the lugs/slots when downhole drilling forces are imposed upon and transmitted through the tool 10. In this regard, the load-transmitting and load-bearing capacities of the tool 10 may be maximized and, for example, sufficient to handle torques applied during application of the apparatus 10, e.g. such as the repetitive forces and conditions applied to downhole equipment during downhole wellbore operations in the oil and gas industry.

Broadly, where the housing and inner tubulars 12,14 are interconnected such that the lugs 20,21 of the housing tubular 12 are locked within the slots 30 (and the 'crown profile' 13 is engaged), and such that the shear pins 43 are in place, torque applied to the tool 10 in the usual string rotational direction will be transferred from the housing tubular 12 to the fishing tubular 14. The interfacing mating surfaces between the lugs 20,21 and slots 30, and between the crown profile 13 keys 42 and notches 44 serve to maximize the torque transferred from above the apparatus 10 to below the apparatus 10 without slippage of the tubulars 12,14 relative to each other, regardless of the rotational direction of the apparatus 10 (i.e. clockwise, RHR, or counterclockwise, LHR).

Without being limited to theory, features or advantages of the presently improved apparatus 10 and methodologies of use arise, at least in part, due to the geometrically predetermined number, shape, and positioning lugs 20,21 and corresponding slots 30 arranged over the length (distance) of the apparatus 10. Advantageously, the presently improved apparatus 10 does not require a threadable engagement between the tubulars 12,14 in order to transmit torque along the apparatus 10, or to disconnect the housing tubular 12 from the fishing tubular 14, as described in more detail below. Advantageously, the presently improved apparatus 10 has the capacity to withstand equal to or greater known repetitive reactive torques applied to drilling string during downhole oilfield operations. Moreover, the configuration of the 'crown' profile 13 of the apparatus 10 in combination with the lugs/slots arrangement are operative to eliminate any applied forces on the shear pins 43, preventing premature fatigue on the shear mechanism despite applied force of torque or reactive torque transmitted through the apparatus 10.

DISCONNECTION—Broadly, according to embodiments, the apparatus 10 may be easily and conveniently activated (or 'engaged') for disconnection of the housing tubular 12 from the fishing tubular 14, where disconnection is desired such as, for example, where downhole equipment has become lodged within a wellbore and separation of the lodged equipment is desired. First, where the rotation of the drill string has stopped or where it is desirable for the drill string to be moved in an upward or downward motion, the apparatus 10 may be activated by shearing shear pins 43, the pins 43 being severed mechanically, hydraulically, or a combination thereof. Pins 43 may be sheared by, for example, slowly pulling up on the drill string while monitoring load until the shear force is exceeded and weight drops off of the indicator. Impact force may also be felt at surface with shearing. Second, once the pins 43 are sheared, an upward pull on the housing tubular 12 results in the housing tubular 12 to telescope upwardly relative to the fishing tubular 14. More specifically, the drill may be set down to neutral weight, torque can be rotated into the drill string while pulling up to slowly rotate off. Downhole torque may continue to be worked until the apparatus 10 releases. Upward pull and rotation on the housing tubular 12 results in the lugs 20,21 on the inner surface 16 of the housing tubular 12 to travel within the T-slot channel, from the downhole terminal stop 33*b* to the uphole terminal stop 33*a*. Third, a small downward force on the housing tubular 12 cause the housing tubular 12 to telescope downwardly again, such that the lugs 20,21 align with the mouth portion 31 of each T-slot 30. Fourth, upward pull, assisted by a piston effect created by seals 23,24, and rotation in the appropriate direction pulls the lugs 21,22 of the housing 12 from their designated T-slots 30 in the fishing tubular 14 and out into the guide channel 32. Finally, continued upward pull on the housing tubular 12 results in the housing tubular 12 traveling upwardly along the guide channel 32 and being pulled free from the fishing tubular 14. As such, disconnection of tubulars 12,14 can readily be performed with only minor rotation (i.e. without a full rotation) of the drill string. Advantageously, as a result of the corresponding geometric proportions between the lugs 20,21 and their corresponding slots 30, as a result of at least one of the lugs 21 differing in size and shape relative to the other lugs 20, partial or improper re-engagement of the tubulars 12,14 is prevented once the lugs 20,21 enter channel 32.

RECONNECTION: Broadly, when a fishing operation is needed to retrieve lodged equipment downhole, methods for reconnecting the presently improved apparatus comprise repeating the steps outlined above during connection of the apparatus 10, save for the insertion of shear pins 43. That is, the housing tubular 12 is run into the hole while slowly rotating the drill string until it engages with and slidably receives the upper end of the fishing tubular 14, and further until lower-most lug 21 on the inner surface 16 of the housing tubular 12 sidewall engages the upper chamfer 34 on the outer surface 27 of the fishing tubular 14 sidewall. Rotation of the drill string can be ceased, as the tubulars 12,14 easily engage one another. No further rotation is required as reconnection of the apparatus 10 is self-guided. Housing tubular 12 may continue to slide down until the drive sub bottoms out, at which point the drill string can then be slowly picked up until overpull is seem to confirm latching between tubulars 12,14. Once overpull is noted, the apparatus 10 is latched and ready for jarring operations. As above, left-hand LH or right-hand RH torque can be applied in either tension or compression.

In some optional embodiments, a conventional fishing head or guide (e.g. conventional fishing tool cut lipped style guide) may be utilized to further enhance reconnection of the tubulars 12,14, as would be appreciated by a person skilled in the art. Continued downward movement of the housing tubular 12 over the fishing tubular 14 results in rotation of the tubulars 12,14 as the lower-most lug 21 of the housing 12 is guided downwardly into and along the guide channel 32, until lower-most lug 21 on the inner surface 16 of the housing tubular 12 engages the lower chamfer 36. As a result, the lower-most lug 21 (and other lugs vertically aligned therewith, 20) engages the lower chamfer 36, further rotation of the tubulars 12,14 occurs as the lugs 20,21 are guided from the guide channel 32 into the mouth portion 31 of the T-shaped slots 30. Continued downward movement of the housing tubular 12 results in the lugs 20,21 engaging the downhole terminal stop 33*b* of the T-shaped slot 30, and corresponding engagement of the keys 42 and notches 44 of the 'crown' profile 13, ceasing movement (longitudinally or radially) between the tubulars 12,14. With the locking mechanism engaged, upward pull on the housing tubular 12 draws the housing upwardly, and the lugs 20,21 from the downhole terminal stop 33*b* of the slots 30 into the uphole terminal stop 33*a* of the slots 30. Such upward pull thus ultimately pulls both tubulars 12,14 and any lodged equipment uphole therewith. As a result, the presently improved apparatus 10 and methodologies of use serve as a simple, effective, and easy-to-use fishing tool capable of conveniently retrieving lodged equipment from the point of engagement and remaining engaged until recovered from the wellbore.

It should be understood that upward and downward movement described herein are for illustrative purposes only, and that the opposite movement, where applicable, may apply. For example, in some embodiments, a downward-upward-downward sequence has been described, but in such cases, opposite or alternative movements may be appropriate or may result from the fabrication of the mechanical parts necessary to implement such a change.

Only minimal rotation of the drill string, i.e. less than one full 360° rotation is required in most embodiments of the presently improved apparatus and methodologies, and only when the tool is properly positioned for triggering. For example, apparatus 10 may only require 20° of rotation to release. Otherwise, any movement of the drill string that might result in minor rotation in either direction, i.e. normal "play" in the drill string, will not unintentionally trigger the tool.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and the described portions thereof.

I claim:

1. An apparatus for use in retrieving equipment from of a subterranean wellbore, the apparatus comprising:

a first housing tubular, the housing tubular forming a central bore having an inner surface providing a plurality of lugs protruding from and longitudinally spaced along the inner surface, the housing tubular having a lower end, the lower end of the housing tubular forming axially extending splines;

a second inner fishing tubular, the fishing tubular having an outer surface forming a plurality of slots corresponding with the plurality of lugs, the fishing tubular having a lower end, the lower end of the fishing tubular forming grooves, a shear mechanism interconnecting the housing tubular and the fishing tubular, wherein, when the fishing tubular is slidably received within the central bore of the housing tubular, the plurality of lugs correspond to and interconnect with the plurality of slots to releasably connect the housing tubular and the fishing tubular, and to transmit axial load and rotational forces between the housing tubular and the fishing tubular;

the axially extending splines correspond to and interconnect with the grooves to transmit torque in either a right-hand or left-hand direction of rotation, and the shear mechanism is configured to maintain the interconnection between the housing tubular and the fishing tubular and to shear upon application of a predetermined force to permit separation of the housing tubular from the fishing tubular.

2. The apparatus of claim 1, wherein the outer surface of the fishing tubular further comprises at least one chamfer for aligning the interconnection between the housing tubular and the fishing tubular.

3. The apparatus of claim 1, wherein the outer surface of the fishing tubular further comprises at least one guide channel for guiding the interconnection between the housing tubular and the fishing tubular.

4. The apparatus of claim 1, wherein the outer surface of the fishing tubular further comprises two diametrically opposed guide channels, each one of the two guide channels extending between at least one upper and lower chamfer.

5. The apparatus of claim 1, wherein the housing tubular has an upper end, the upper end of the housing tubular configured for connection with an adapter.

6. The apparatus of claim 1, wherein the slots comprise a plurality of T-shaped slots.

7. The apparatus of claim 1, wherein the plurality of lugs comprises at least four lugs.

8. The apparatus of claim 7, wherein one of the plurality of lugs is of a different size and shape than the other at least three lugs.

9. The apparatus of claim 1, wherein the housing tubular forms a plurality of shear pin holes and the fishing tubular forms a plurality of shear pin grooves, the shear pin holes and shear pin grooves correspondingly aligned and operative to receive a plurality of shear pins.

10. The apparatus of claim 1, wherein the apparatus is configured to be positioned within a drill string.

11. A method of retrieving equipment from a subterranean wellbore, the method comprising:

providing at least one apparatus for retrieving the equipment, the apparatus comprising:

a first housing tubular releasably connected and rotatable with a second fishing tubular, the first housing tubular forming a central bore having an inner surface providing a plurality of lugs protruding from and longitudinally spaced along the inner surface and having a lower end forming axially extending splines for interconnecting with corresponding grooves of the second fishing tubular, the second fishing tubular having an outer surface forming a plurality of slots corresponding with the plurality of lugs, and a shear mechanism interconnecting the first housing tubular and the second fishing tubular;

lowering the apparatus into the wellbore, interconnecting the first housing tubular and the second fishing tubular downhole by engaging the plurality of lugs with the plurality of slots to releasably connect the first housing tubular and the second fishing tubular and to transmit axial load and rotational forces therebetween, and by interconnecting the axially extending splines with the corresponding grooves to transmit torque in either a right-hand or left-hand direction of rotation;

disconnecting the first housing tubular from the second fishing tubular by rotatably disengaging the first housing tubular from the second fishing tubular and removing the first housing tubular from the wellbore; and reconnecting the first housing tubular with the second fishing tubular by lowering the first housing tubular into the wellbore and rotatably reengaging the plurality of lugs with the plurality of slots and interconnecting the axially extending splines with the corresponding grooves for removal of the apparatus and for retrieving the equipment from the wellbore.

12. The method of claim 11, wherein the at least one apparatus is configured for connection with a drill string for lowering into the wellbore.

13. The method of claim 12, wherein the at least one apparatus is disconnected to separate a lower section of the drill string positioned downhole of the apparatus from an upper section of the drill string positioned uphole of the apparatus.

14. The method of claim 13, wherein, once disconnected, the method further comprises removing the upper section of the drill string from the wellbore.

15. The method of claim 12, wherein a plurality of apparatus are provided in the drill string.

16. The method of claim 11, wherein the disconnection of the first housing tubular occurs by rotation of the tubular in either the clockwise or counter-clockwise direction.

17. The method of claim 11, wherein the disconnection and reconnection of the apparatus occurs multiple times.

* * * * *